US005784676A

United States Patent [19]

Iseki et al.

[11] Patent Number: 5,784,676

[45] Date of Patent: Jul. 21, 1998

[54] ROLLER FOR BELT TRANSPORTING APPARATUS AND IMAGE FORMING APPARATUS

[75] Inventors: Shuji Iseki; Norio Hokari; Yukio Hayashi; Junichirou Sameshima; Mikio Kobayashi; Ryoichi Tsuruoka, all of Ebina, Japan

[73] Assignee: Fuji Xerox Co., Ltd., Tokyo, Japan

[21] Appl. No.: 632,071

[22] Filed: Apr. 15, 1996

[30] Foreign Application Priority Data

| | | | |
|---|---|---|---|
| Apr. 14, 1995 | [JP] | Japan | 7-089038 |
| Jun. 30, 1995 | [JP] | Japan | 7-166691 |
| Jun. 30, 1995 | [JP] | Japan | 7-166692 |

[51] Int. Cl.[6] ..... G03G 15/00; G03G 15/16

[52] U.S. Cl. ..... 399/301; 347/116; 399/9; 399/165

[58] Field of Search ..... 198/810.03; 399/11, 399/31, 36, 43, 162, 165, 299, 301, 302, 308, 312, 9; 347/116

[56] References Cited

U.S. PATENT DOCUMENTS

| | | | |
|---|---|---|---|
| 4,365,888 | 12/1982 | Hosaka et al. | 399/36 |
| 5,070,365 | 12/1991 | Agarwal | 399/165 |
| 5,175,570 | 12/1992 | Haneda et al. | 347/116 |
| 5,383,006 | 1/1995 | Castelli | 399/165 |
| 5,574,527 | 11/1996 | Folkins | 399/9 |
| 5,629,760 | 5/1997 | Hayashi et al. | 399/312 |

FOREIGN PATENT DOCUMENTS

| | | |
|---|---|---|
| 58-177811 | 10/1983 | Japan . |
| 5-1751 | 1/1993 | Japan . |
| 5-69979 | 3/1993 | Japan . |
| 5-127543 | 5/1993 | Japan . |
| 5-319611 | 12/1993 | Japan . |
| 6-64773 | 3/1994 | Japan . |

*Primary Examiner*—Arthur T. Grimley
*Assistant Examiner*—Sophia S. Chen
*Attorney, Agent, or Firm*—Oliff & Berridge, PLC

[57] ABSTRACT

A belt transporter roller for an image forming apparatus according to the present invention has a rotating shaft of an elastic roller; and an elastic fin wound around the rotating shaft and provided along an axial direction thereof, the fin including at least two spiral groups different in winding direction.

16 Claims, 41 Drawing Sheets

(RELATED ART)

ROLLER FOR BELT TRANSPORTING APPARATUS AND IMAGE FORMING APPARATUS

BACKGROUND OF THE INVENTION

1. Field of the Invention

This invention relates to an image forming apparatus such as a copier, a printer, or a facsimile using an electrophotographic system. Particularly, the present invention relates to an image forming apparatus which has an endless transfer belt and a plurality of support rollers for supporting the transfer belt, and can prevent damage to the end of the transfer belt formed like an endless shape.

2. Description of the Related Art

In recent years, color printing of documents processed in offices, etc., has been rapidly increasing and image forming apparatus such as copiers, printers, and facsimiles for handling the documents have been equipped with a color printing capability explosively. At present, the color machines tend to provide high image quality and operate at high speed with high quality and speedup of business processing in offices, etc. As a color machine to meet such requirements, for example, a so-called tandem color image forming apparatus is already proposed and is brought to the commercial stage. It has image formation units in a one-to-one correspondence with colors of black (K), yellow (Y), magenta (M), and cyan (C) and executes multiple transfer of images different in color formed by the image formation units onto a transfer medium or an intermediate transfer body held and transported on a transfer belt shaped like an endless belt for forming a color image.

Such a tandem color image forming apparatus is, for example, as shown in FIG. 34. As shown here, the tandem color image forming apparatus comprises four color image formation units of a black image formation unit 100K for forming a black (K) image, a yellow image formation unit 100Y for forming a yellow (Y) image, a magenta image formation unit 100M for forming a magenta (M) image, and a cyan image formation unit 100C for forming a cyan (C) image, which are spaced from each other at give intervals and placed horizontally. Placed below the black, yellow, magenta, and cyan color image formation units 100K, 100Y, 100M, and 100C is a transfer belt 102 shaped like an endless belt for transporting transfer paper 101 across transfer positions of the color image formation units 100K, 100Y, 100M, and 100C with the transfer paper 101 electrostatically attracted. This transfer belt 102 is shaped like an endless belt by forming, for example, a synthetic resin film of polyethylene terephthalate, polyvinylidene fluoride, etc., having flexibility like a band and connecting both ends of the synthetic resin film formed like a band by means of welding, etc. It is held circulatably by a plurality of rollers including a drive roller and is circulated by the drive roller at a predetermined move speed.

The black, yellow, magenta, and cyan color image formation units 100K, 100Y, 100M, and 100C are the same in configuration and form black, yellow, magenta, and cyan toner images respectively in sequence, as described above. Each of the color image formation units 100K, 100Y, 100M, and 100C comprises a photosensitive drum 103. The surface of the photosensitive drum 103 is uniformly charged by an corotron 104 for primary charge, then is scanned by and exposed to a laser beam 105 for image formation in response to image information for forming an electrostatic latent image. The electrostatic latent images formed on the surfaces of the photosensitive drums 103 are developed with black toner, yellow toner, magenta toner, and cyan toner by developing machines 106 of the color image formation units 100K, 100Y, 100M, and 100C to form visible toner images, which then are before-transfer charged by before-transfer chargers 107, then charged by transfer chargers 108 for transfer to the transfer paper 101 held on the transfer belt 102 in sequence. The transfer paper 101 to which the black, yellow, magenta, and cyan toner images have been transferred is detached from the transfer belt 102, then is fixed by a fuser (not shown) for forming a color image.

Further, the transfer paper 101 is supplied from a paper feed cassette (not shown) and is transported on the transfer belt 102 at a predetermined timing by a resist roller 115. It is also held and transported on the transfer belt 102 by a paper holding charger (not shown) and a charge roller (not shown).

In FIG. 34, numeral 109 denotes a photosensitive body cleaner, numeral 110 denotes a photosensitive body electricity removal lamp, numeral 111 denotes a paper stripping corotron, numeral 112 denotes a transfer belt electricity removal corotron, numeral 113 denotes a transfer belt cleaner which includes a cleaning brush **113*a* and a cleaning blade 113*b*, and numeral 114** denotes a cleaning preprocessing corotron.

The tandem color image forming apparatus thus configured, which forms one image consecutively by a plurality of image formation units, can operate at a fairly high speed.

By the way, in the color image forming apparatus, the transfer belt 102 is placed on rollers 116 and 117 and is circulated at a predetermined speed along the arrow direction in FIG. 34 by rotating the drive roller 116, one of the rollers.

With the color image forming apparatus forming a color image by transporting the transfer paper 101 on the transfer belt circulated by the rollers 116 and 117 with the paper held, it is important to transport the transfer paper 101 precisely on a predetermined passage as a precondition for forming a high-quality color image without any color shift. Therefore, it becomes necessary that the transfer belt 102 for transporting the transfer paper 101 does not move in a direction perpendicular to the forwarding direction when it is circulated.

However, it is substantially impossible to completely prevent the transfer belt 102 from moving in the width direction because of incomplete shaping of the transfer belt 102 and the rollers 116 and 117 and the parallelism of the rollers on which the transfer belt 102 in placed.

Then, with conventional color image forming apparatus, various techniques have been proposed to regulate a move of the transfer belt 102 in the width direction thereof on the rollers 116 and 117 for preventing the belt from snaking, which will be hereinafter referred to as "taking a belt walk."

As one of the techniques, for example, as shown in FIG. 35, a non-rotating guide member 121 is fixed to a frame 122 at one end of a cylindrical rigid roller 120 and the roller angle is adjusted so as to cause a transfer belt 102 placed on the roller to take a belt walk in the direction of the guide member 121.

According to this technique, the end face of the transfer belt 102 always comes in contact with a guide face 123 on the inner side of the guide member 121 in rub relation, so that the transfer belt 102 is held in a predetermined position relative to the guide face 123.

However, in the technique, the end face of the transfer belt 102 is pressed against the guide member 121 by a force attempting to cause the transfer belt 102 to take a belt walk, thus a large external force is applied to the end of the transfer belt 102, easily resulting in buckling or breakage at the edge of the transfer belt 102.

Then, as a technique for solving such a problem, a belt support transporter is already proposed in Japanese Patent Laid-Open No. Sho 58-177811, etc. As shown in FIGS. 36A and 36B, the proposed belt support transporter is a roller formed like substantially a cylindrical shape having elastic petals 131 provided by dividing the circumference of a circle into four places and placed spirally with respect to a shaft core member 130. With a device having this roller and the guide member 121 shown in FIG. 35 in combination, if the placed transfer belt 102 abuts the guide member 121 and is ready to cause buckling, the elastic petals 131 become elastically deformed, weakening the external force acting on the belt end face, reducing damage to the transfer belt 102. Therefore, while breakage of the transfer belt 102 is prevented, belt walk can be reduced to some extent.

Techniques for solving the problem are also proposed in Unexamined Japanese Patent Publication (kokai) Nos. Hei 5-1751, 5-69979, 5-127543, 5-319611, etc.

With a belt snaking prevention apparatus according to Unexamined Japanese Patent Publication (kokai) No. Hei 5-1751, a belt formed like an endless shape is placed on at least two rollers and is run between the rollers by rotating one of the rollers, wherein the one roller is supported on a holding member pivotally supported swingably with one point as a support shaft and the holding member is provided with a guide member for guiding both end margins of the run belt.

With a belt snaking controller according to Unexamined Japanese Patent Publication (kokai) No. Hei 5-69979, a belt formed like an endless shape is placed on at least two rollers and is run between the rollers by rotating one of the rollers and the one roller, which is provided swingable, is swung in any direction alternately, thereby controlling belt snaking, wherein the rotation force of a drive source for rotating the drive roller for running the belt is used to swing the roller provided swingably so as to incline to the rotating shaft of the drive roller.

A toner image transfer system according to Unexamined Japanese Patent Publication (kokai) No. Hei 5-127543 comprises a support board, a move board coupled to the support board, unit for coupling the support and move boards, a first roller supported rotatably on the support board, a second roller supported rotatably on the coupling unit, and a paper conveyor belt being placed on the two rollers for transporting paper so that the paper comes in contact with the toner image support surface, wherein the coupling unit can change the coupling of the move board to the support board between a fixed state and a semifixed state enabling a linearly relative move.

With an endless belt transporter according to Unexamined Japanese Patent Publication (kokai) No. Hei 5-319611, a belt member is placed on a drive roller and a plurality of driven rollers and circulates at a predetermined speed with the rotation of the drive roller, wherein one of the driven rollers is an edge guide roller for guiding the end of the belt member, by which belt member snaking is prevented.

However, the conventional arts have the following problems: For the device having the belt support transporter disclosed in Unexamined Japanese Patent Publication (kokai) No. Sho 58-177811 and the guide member 121 shown in FIG. 35 in combination, it is substantially impossible to shape completely straight the belt end face 102*a* that the guide member 121 abuts. Thus, as shown in FIGS. 37A and 37B, when the guide member 121 traces the belt end face, in reverse it applies an external force to the transfer belt 102 and point A on the transfer belt 102 moves to point A' along the path as indicated by the broken line in FIG. 37B. Therefore, the conventional fixed guide member 121 cannot avoid a belt walk caused by incomplete shaping of the belt end face 121*a*.

For the spiral elastic petals 131, a walk force acts easily on the transfer belt 102 because of the spiral winding direction of the elastic petals 131 and the edge force furthermore increases.

With the conventional guide member 121, the belt walk regulating force acts directly on the belt end face 102*a* and if waviness occurs in the shape of the belt end face 102*a* as described above, a stress concentrates on a part of the belt end face 102*a*; buckling or a fracture occurs at the end of the transfer belt 102 and further the transfer belt 102 runs onto the guide member 121 and is stretched, etc., and becomes unserviceable.

In the techniques disclosed in Unexamined Japanese Patent Publication (kokai) Nos. Hei 5-1751, 5-69979, 5-127543, 5-319611, etc., although the guide member, etc., for guiding both end margins of the run belt is provided or the roller is swung in any direction alternately, a belt walk caused by the incomplete shaping of the belt end face cannot be avoided, and a mechanism for swinging the roller is required, complicating the structure.

As an art to solve the problem, the present applicant has already proposed a technique disclosed in Unexamined Japanese Patent Publication No. Hei 6-64773.

An endless belt transporter in an image forming apparatus shown in Unexamined Japanese Patent Publication (kokai) No. Hei 6-64773 proposed by the applicant has an endless belt placed on rollers including at least a drive roller and tension addition roller and driven. It comprises a roller formed of an elastic member and having a large number of slits made on the surface, a support member for pivotally supporting the roller, and a belt guide member being pivotally supported movably in the axial direction of the roller for elastically supporting the belt end with respect to the support member, wherein a spring constant of the belt guide member is made smaller than the axial rigidity of the belt in the endless belt transporter.

The endless belt transporter in the image forming apparatus shown in Unexamined Japanese Patent Publication (kokai) No. Hei 6-64773 proposed by the applicant further includes a mechanism for calculating a snaking speed from displacement of the belt or belt guide member and when the snaking speed falls below a given value, stopping the belt.

The endless belt transporter in the image forming apparatus shown in Unexamined Japanese Patent Publication (kokai) No. Hei 6-64773 proposed by the applicant, which comprises the belt guide member being pivotally supported movably in the axial direction of the roller for elastically supporting the belt end with respect to the support member, can absorb a belt walk caused by the incomplete shaping of the belt end face in the belt guide member and prevent buckling, a fracture, etc., from occurring at the end of the belt.

However, with the endless belt transporter in the image forming apparatus shown in Unexamined Japanese Patent Publication (kokai) No. Hei 6-64773 proposed by the applicant, a foreign substance of dust, dirt, etc., is deposited on the surface of any of the rollers including at least a drive roller and tension addition roller on which the endless belt is placed for driving the endless belt and the outer diameter of the roller partially changes, or uneven abrasion, plastic deformation of the rollers, or the like occurs or the rollers on which the endless belt is placed are partially out of parallelism because of time-varying change with long-term use of the image forming apparatus. Then, the belt walk distance of the endless belt abnormally increases, the endless belt greatly displaces the belt guide member, the end of the belt comes in contact with the members such as the belt frame for placing the belt thereon and turns, buckling or a fracture occurs at the edge of the belt, and the belt runs onto the guide member and is stretched with plastic deformation; the transfer belt becomes unserviceable.

The endless belt transporter in the image forming apparatus shown in Unexamined Japanese Patent Publication (kokai) No. Hei 6-64773 proposed by the applicant further includes a mechanism for calculating a snaking speed from displacement of the belt or belt guide member and when the snaking speed falls below a given value, stopping the belt. In this case, the mechanism for sensing the belt snaking becomes complicated and increases costs. In addition, it is feared that erroneous sensing of the belt snaking speed, etc., may cause the belt to accidentally stop, disabling the transporter from being used. Further, with the endless belt transporter, even if the belt is stopped when the snaking speed calculated from displacement of the belt or belt guide member falls below a given value, some users of the color image forming apparatus may once turn off and again turn on the power of the system, thereby restoring the color image forming apparatus to the initial state for continuing the color image formation process without immediately calling the service engineer; the end of the belt comes in contact with the members such as the belt frame for placing the belt and turns, making the transfer belt unserviceable.

Further, the conventional art has the following problem for making the transfer belt unserviceable:

If the mutual positional relationship among the rollers changes in the conventional art, the transfer belt will move in the rotating shaft direction of the rollers. When the move distance of the transfer belt exceeds a predetermined distance, the transfer belt will abut the frame, etc., for supporting the rollers and become damaged.

For example, for two rollers with their rotating shafts disposed in parallel, the mutual positional relationship change among the rollers is an axial change in the plane containing the two rotating shafts or an axial change in a direction intersecting the plane. In the description that follows, the former is called parallelism change and the latter is called change in a twist direction.

By the way, the mutual positional relationship among the rollers may change, for example, in the case where the frame is distorted or in the case where the attachment state of the rollers and frame changes.

Specifically, as an example of the former case, in an image forming apparatus having a frame made up of a main frame where an image support, etc., is disposed and a roller frame where a plurality of rollers are disposed, the roller frame being disposed movably to the main frame, the roller frame may be unable to be fixed to a predetermined position of the main frame and an unnecessary force may act on the roller frame, etc., distorting the roller frame, etc. In this case, it is considered that change in a twist direction mainly occurs.

In the image forming apparatus having the image support and transfer belt, generally the image support and transfer belt are disposed movably and the image support or transfer belt can be moved for removing jammed paper.

As an example of the latter case, in an image forming apparatus wherein rollers are disposed on a frame via bearings, etc., to dispose the rollers rotatably on the frame, the bearings may wear in a time-varying manner, a gap being formed between the bearings and the rollers, or the bearings together with the rollers may fall off from the frame. In this case, parallelism change is considered to mainly occur because a transfer belt placed on the rollers causes the trouble-occurring roller to be attracted in another roller direction.

SUMMARY OF THE INVENTION

It is an object of the invention to provide transfer belt rollers of an image forming apparatus capable of reducing a walk force given by rollers having spiral elastic fins to a transfer belt, thereby reducing an edge force acting on an end of the transfer belt.

It is another object of the invention to provide an image forming apparatus capable of reliably preventing damage such as buckling or a fracture from occurring at an end of a transfer belt in a simple structure at low costs if the transfer belt abnormally moves in a direction perpendicular to the forwarding direction of the transfer belt.

It is another object of the invention to provide an image forming apparatus capable of preventing damage to a transfer belt if positional interrelationships among rollers change.

A belt transporter roller according to the present invention is comprised of: a rotating shaft of an elastic roller; and an elastic fin wound around the rotating shaft and provided along an axial direction thereof, the fin including at least two spiral groups different in winding direction.

An image forming apparatus according to the present invention is comprised of: an endless transfer belt; and a plurality of rollers for supporting and transporting the transfer belt; at least one of the plurality of rollers including: a guide member being disposed at one or both ends for guiding the transfer belt while allowing a predetermined amount of motion in an edge direction of the transfer belt; and a sensor for sensing an abnormal move of the transfer belt in a direction perpendicular to a forwarding direction thereof to prevent damage to edges of the transfer belt.

As shown in FIG. 1, an image forming apparatus according to present invention is comprised of: an endless transfer belt 01; a plurality of rollers for supporting and transporting the transfer belt 02, 03 04; a detector for detecting a change in positional interrelationships among belt support rollers; and belt drive controller for inhibiting the transfer belt from being driven when the positional relationships change.

In the transfer belt roller of the image forming apparatus according to the invention, the spiral elastic fin consists of at least two spiral groups different in spiral winding direction, so that the walk forces of the spiral groups acting on the transfer belt cancel each other and an edge force acting on an end of the transfer belt can be reduced.

In the image forming apparatus according to the invention, a guide member is disposed at an end of at least one of the belt support rollers for guiding the transfer belt while allowing a predetermined amount of motion in the edge direction of the transfer belt. Thus, a belt walk caused by the incomplete shaping of the transfer belt end face can be absorbed in the guide member for guiding the transfer belt while allowing a predetermined amount of motion in the edge direction of the transfer belt; if the transfer belt end face is Incompletely shaped, buckling, a fracture, etc., can be prevented from occurring at the end of the transfer belt. The color image forming apparatus senses an abnormal move of the transfer belt in the direction perpendicular to the forwarding direction of the transfer belt and prevents damage to the edge of the transfer belt. Thus, if a foreign substance of dust, dirt, etc., is deposited on the surface of any of the rollers on which the transfer belt is placed for driving the transfer belt and the outer diameter of the roller partially changes, or uneven abrasion, plastic deformation of the rollers, or the like occurs or the rollers on which the transfer belt is placed are partially out of parallelism because of time-varying change with long-term use of the color image forming apparatus, an abnormal move of the transfer belt in the direction perpendicular to the forwarding direction of the transfer belt can be sensed for preventing damage to the edge of the transfer belt and the transfer belt from becoming unserviceable.

Further, In the image forming apparatus according to the invention, the detection unit detects a change in positional interrelationships among the belt support rollers and when the positional relationships change, the transfer belt drive control unit inhibits the transfer belt from being driven. If the positional interrelationships among the belt support rollers change and the transfer belt moves in the belt support roller rotating shaft direction, the transfer belt can be stopped before the transfer belt moves exceeding a predetermined distance.

PREFERRED EMBODIMENTS OF THE INVENTION

Referring now to the accompanying drawings, there are shown preferred embodiments of the invention.

Figure 1:
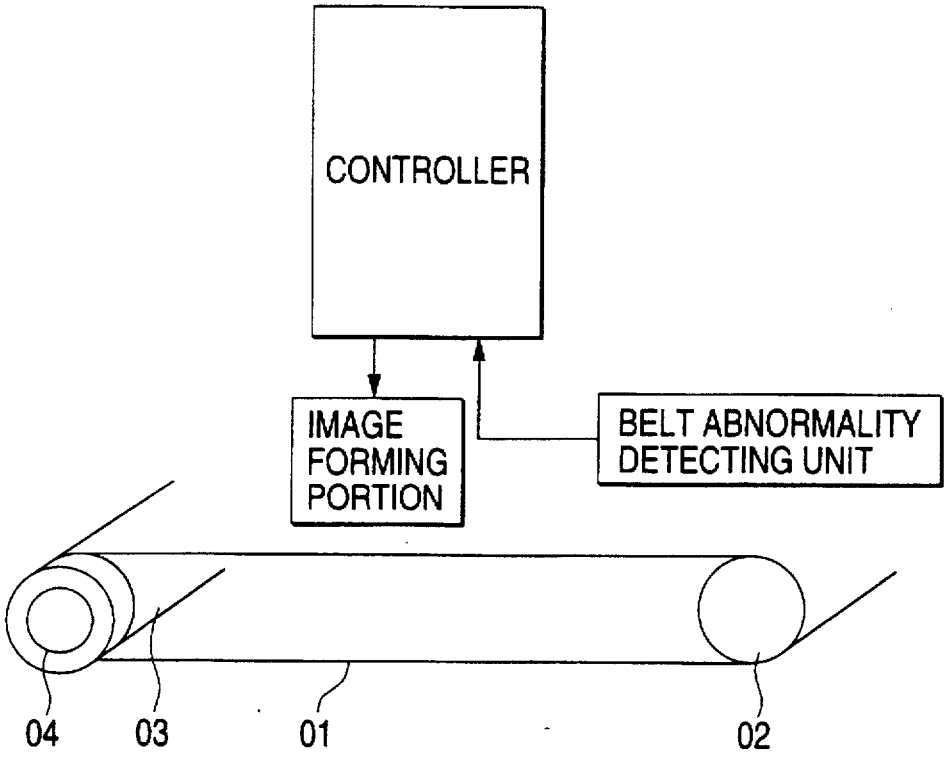
FIG. 1 is a block diagram to show the concept of an image forming apparatus according to the invention.
Figure 2:
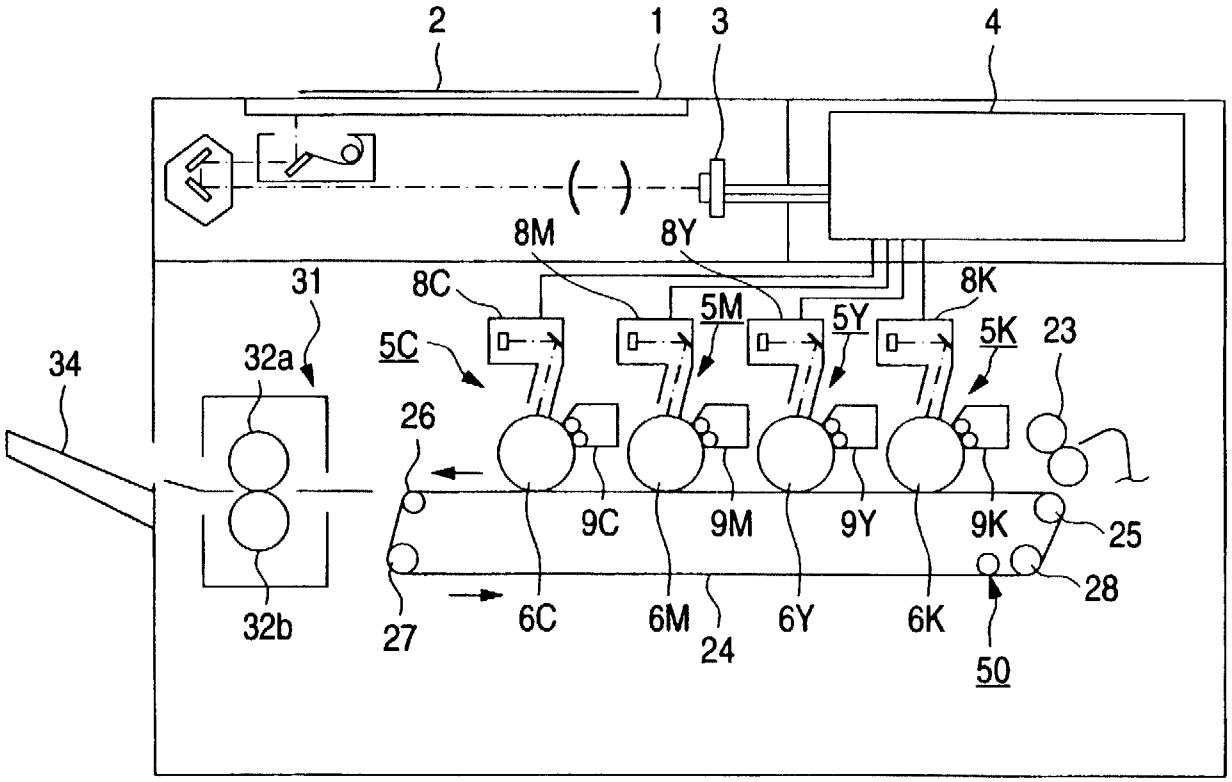
FIG. 2 is a general drawing to show the structure of a digital color copier as one embodiment of an image forming apparatus according to the invention.

FIG. 2 is a general drawing to show the structure of a digital color copier as one embodiment of an image forming apparatus according to the invention.

In FIG. 2, a document 2 placed on a platen glass 1 is read as RGB analog image signals by an image scanner comprising a color CCD sensor 3 via a scan optical system consisting of a light source, a scan mirror, etc. The RGB analog image signals read by the color CCD sensor 3 are converted into KYMC image signals by an image processing section 4 and the KYMC image signals are temporarily stored in a memory contained in the image processing section 4.

Figure 3:
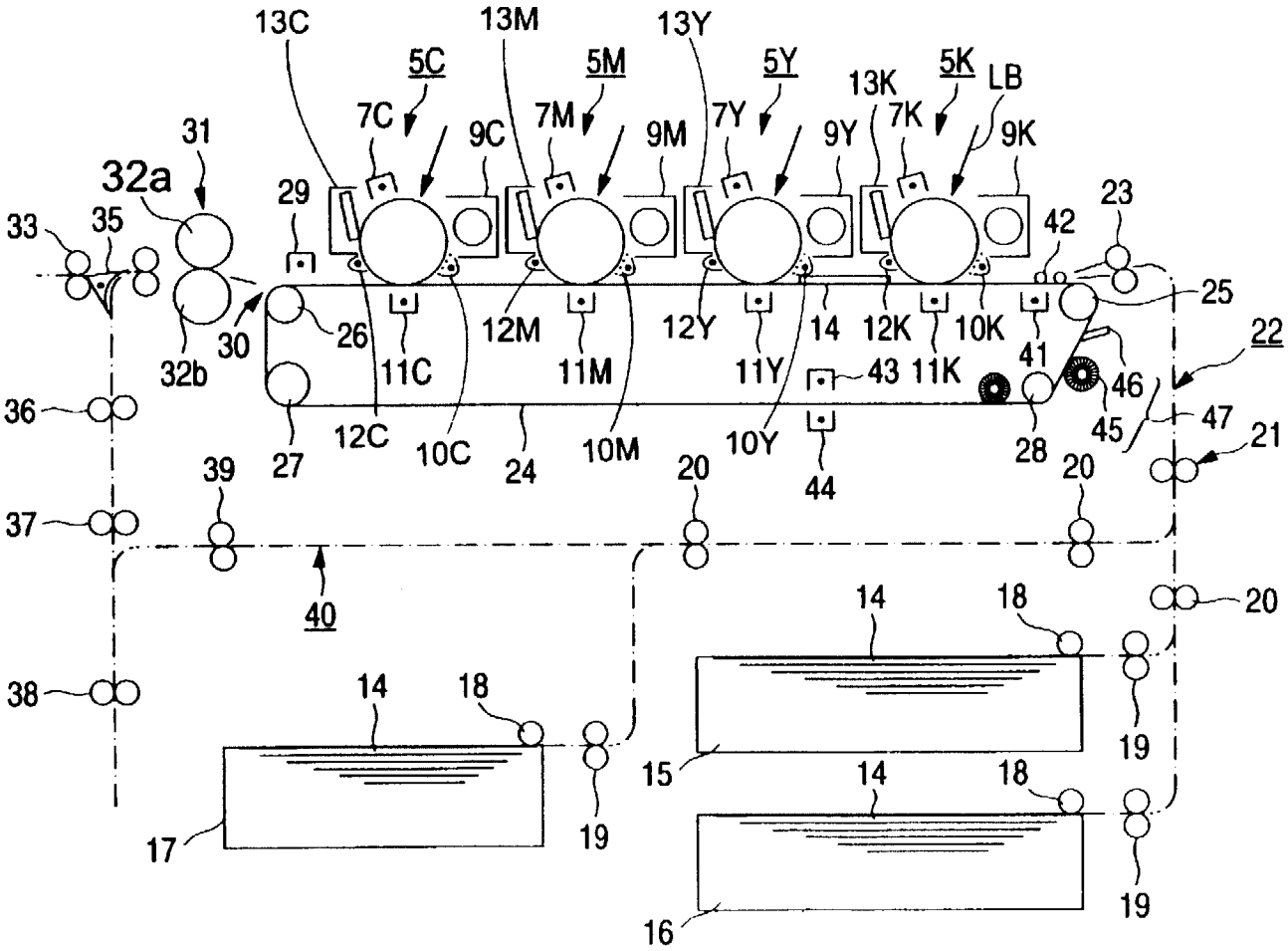
FIG. 3 is a drawing to show the structure of an image formation section of the digital color copier as the embodiment of the image forming apparatus according to the invention.

As shown in FIGS. 2 and 3, the image processing section 4 outputs black (K), yellow (Y), magenta (M), and cyan (C) color image data in sequence to laser beam scanners 8K, 8Y, 8M, and 8C of black (K), yellow (Y), magenta (M), and cyan (C) color image formation units 5K, 5Y, 5M, and 5C, and the surfaces of photosensitive drums 6K, 6Y, 6M, and 6C are scanned by and exposed to laser beams LBs output by the laser beam scanners 8K, 8Y, 8M, and 8C in response to the image data for forming electrostatic latent images. These electrostatic latent images formed on the photosensitive drums 6K, 6Y, 6M, and 6C are developed as black (K), yellow (Y), magenta (M), and cyan (C) color toner images respectively by developing machines 9K, 9Y, 9M, and 9C.

Transfer paper 14 of a predetermined size to which the color toner images formed on the photosensitive drums 6K, 6Y, 6M, and 6C are to be transferred is transported from any of paper feed Cassettes 15, 16, and 17 via a paper transport passage 22 made up of a paper feed roller and paper transport roller pairs 19, 20, and 21. The transfer paper 14 supplied from any of the paper feed cassettes 15–17 is sent onto a transfer belt 24 by a resist roller 23 rotated at a predetermined timing. The transfer belt 24 is placed on a drive roller 25, a stripping roller 26, a tension roller 27, and an idle roller 28 endlessly under a given tension, and is circulated at a predetermined speed in the arrow direction by the drive roller 25 rotated by a dedicated motor (not shown) having an excellent constant speed property. Used as the transfer belt 24 is, for example, a belt shaped like an endless belt by forming a synthetic resin film of polyethylene terephthalate, polyvinylidene fluoride, etc., having flexibility like a band and connecting both ends of the synthetic resin film formed like a band by means of welding, etc. A belt back surface cleaner 50 cleans the back of the transfer belt 24.

The paper feed timing and image write timing are determined so that the tip of the transfer paper 14 transferred on the transfer belt 24 and the tip of the image formed on the first photosensitive drum 6K by the first image formation unit 5K match in the lowest transfer point of the photosensitive drum 6K. The visible image on the photosensitive drum 6K is transferred by a transfer corotron 11K to the transfer paper 14 arriving at the transfer point, and further the transfer paper 14 arrives at a transfer point just below the photosensitive drum 6Y. Likewise, the visible image on the photosensitive drum 6Y is transferred to the transfer paper 14 arriving at the transfer point just below the photosensitive drum 6Y. When the visible images on other photosensitive drums have been transferred to the transfer paper 14 in a similar manner, the transfer paper 14 is furthermore transported on the transfer belt 24. When the transfer paper 14 reaches the proximity of the stripping roller 26, it undergoes electricity removal by a electricity removal corotron 29 for stripping and is stripped from the transfer belt 24 by the stripping roller 26 whose curvature radius is set small and a stripping claw 30. Then, the transfer paper 14 to which the four color toner images have been transferred is fixed by a fuser 31 with a heating roller 32*a* and a pressurizing roller 32*b* and is discharged onto a discharge tray 34 shown in FIG. 2 by a discharge roller pair 33, and a color image is copied.

To copy a full color image to both sides of the transfer paper 14, as shown in FIG. 3, without discharging the transfer paper 14 formed with a color image on one side by the discharge roller pair 33, the transport direction of the transfer paper 14 is changed downward by a change plate 35 and the transfer paper 14 turned out is transported via a paper transport passage 40 made up of paper transport roller pairs 36, 37, 38, 39, etc., to the transfer belt 24 again through the paper transport passage 22, then a color image is formed on the rear face of the transfer paper 14 in a similar process as described above.

As shown in FIG. 3, the black, yellow, magenta, and cyan color image formation units 5K, 5Y, 5M, and 5C are the same in configuration and form black, yellow, magenta, and cyan toner images respectively in sequence, as described above. The color image formation units 5K, 5Y, 5M, and 5C comprise photosensitive drums 6K, 6Y, 6M, and 6C. The surfaces of the photosensitive drums 6K, 6Y, 6M, and 6C are uniformly charged by acorotrons 7K, 7Y, 7M, and 7C for primary charge, then are scanned by and exposed to laser beams LBs for image formation output in response to image data for forming electrostatic latent images corresponding to the colors. The electrostatic latent images formed on the surfaces of the photosensitive drums 6K, 6Y, 6M, and 6C are developed with black toner, yellow toner, magenta toner, and cyan toner by the developing machines 9K, 9Y, 9M, and 9C of the color image formation units 5K, 5Y, 5M, and 5C to form visible toner images, which then are before-transfer charged by before-transfer chargers 10K, 10Y, 10M, and 10C, then charged by transfer chargers 11K, 11Y, 11M, and 11C for transfer to the transfer paper 14 held on the transfer belt 24 in sequence. The transfer paper 14 to which the black, yellow, magenta, and cyan toner images have been transferred is detached from the transfer belt 24, then is fixed by the fuser 31 for forming a color image, as described above.

Further, the transfer paper 14 is supplied from any of the paper feed cassettes 15–17 by roller 18 and is transported on the transfer belt 24 at a predetermined taming by the resist roller 23. It is also held and transported on the transfer belt 24 by a paper holding charger 41 and a charge roller 42.

After the completion of the toner image transfer step, the photosensitive drums 6K, 6Y, 6M, and 6C undergo electricity removal by before-cleaning electricity remover 12K, 12Y, 12M, and 12C and remaining toner, etc., on the drums is removed by cleaners 13K, 13Y, 13M, and 13C for the next image formation process.

After the transfer paper 14 is stripped off, the transfer belt 24 undergoes electricity removal by transfer belt electricity removal corotron pairs 43 and 44 in the circulating track, and toner, paper powder, and the like on the surface of the transfer belt 24 are removed by a cleaning unit 47 consisting of a rotating brush 45 and a blade 46.

By the way, in the embodiment, in the color image forming apparatus having the transfer belt formed like an endless shape and support rollers for supporting the transfer belt, guide members for guiding the transfer belt while allowing a predetermined amount of motion in the edge direction of the transfer belt are disposed on the ends of at least one of the support rollers, and an abnormal move of the transfer belt in a direction perpendicular to the transfer belt forwarding direction is sensed for preventing damage to the edges of the transfer belt.

In the embodiment, when an abnormal move in the direction perpendicular to the transfer belt forwarding direction has been sensed n times regardless of whether the power is on or off, the transfer belt is stopped.

That is, the transfer belt 24 is placed on the drive roller 25, the stripping roller 26, the tension roller 27, and the idle roller 28 endlessly under a given tension, and is circulated at a predetermined speed in the arrow direction by the drive roller 25 rotated by the dedicated motor (not shown) having an excellent constant speed property.

Figure 5:
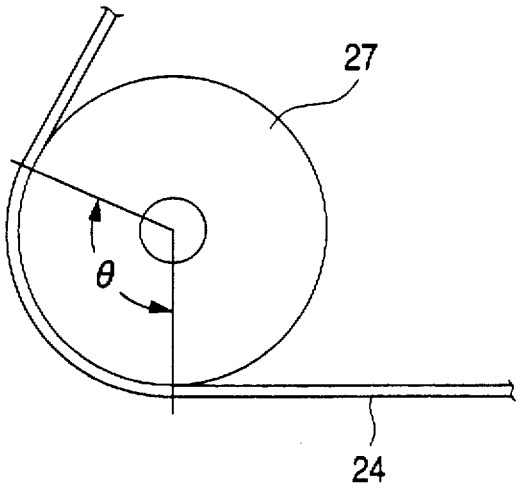
FIG. 5 is a side view to show the proximity of a tension roller.
Figure 6:
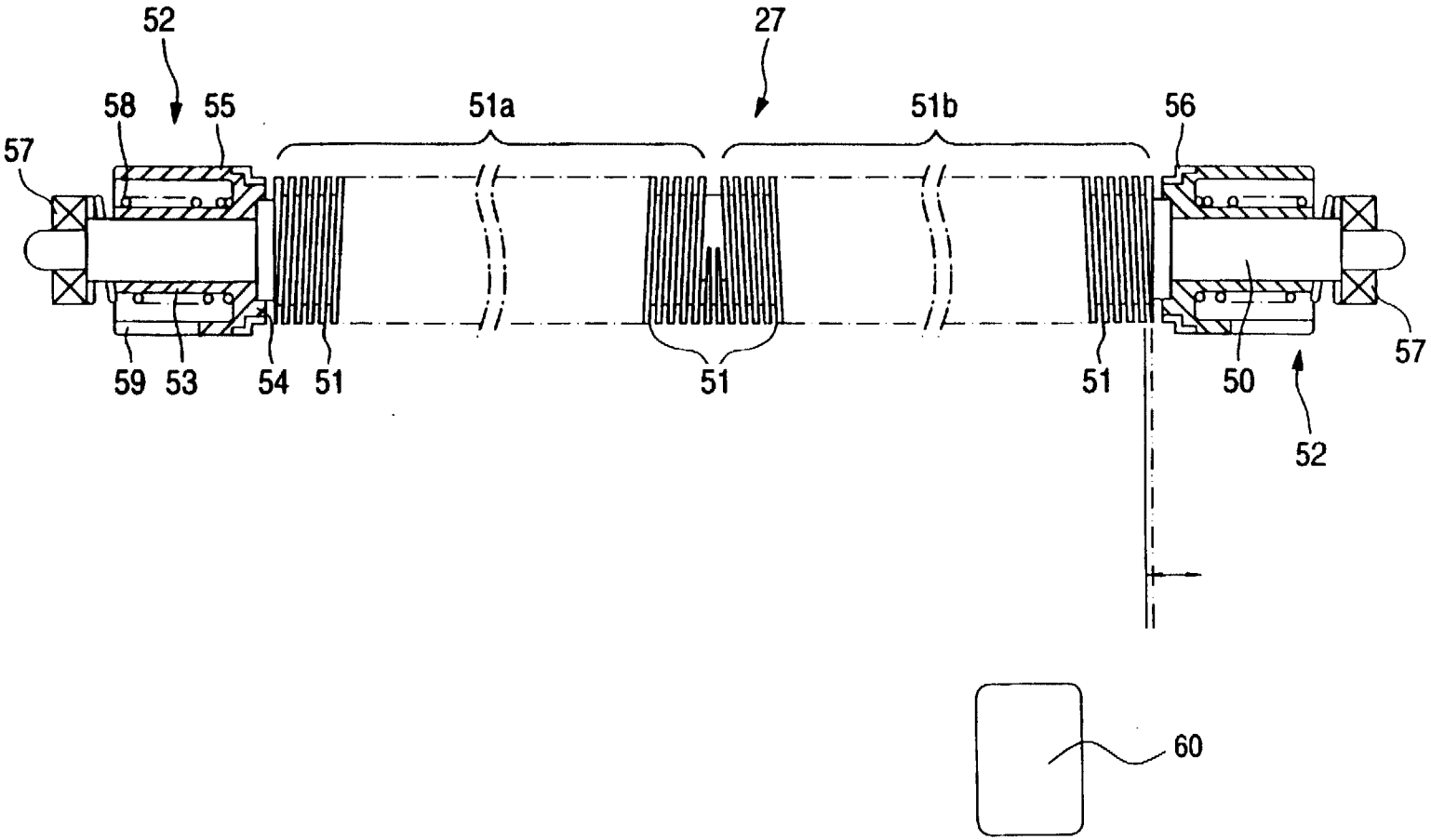
FIG. 6 is a partially broken away front view to show the tension roller.
Figure 7:
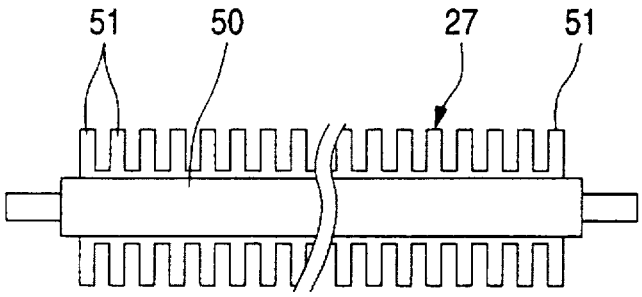
FIG. 7 is a partially broken away sectional view to show the tension roller.

A roller called an LLF (low lateral force) roller is used as the tension roller 27 providing a large lap angle θ of the transfer belt 24, for example, as shown in FIG. 5. In addition to the tension roller 27, all rollers except the drive roller 25 may be made of LLF rollers. As shown in FIGS. 6 and 7, the tension roller 27 made of an LLF roller comprises a metal shaft member 50, and a belt supporting sleeve member (fin) 51 made of flexible material such as rubber or synthetic resin is projected like a plate outward in the radial direction on the outer peripheral surface of the shaft member 50. The elastic fin 51 is made in series spirally in predetermined spacing along the axial direction of the shaft member 50 and is divided into left and right elastic fins 51*a* and 51*b* with the center as a boundary. The spiral directions of the left and right elastic fins 51*a* and 51*b* are made opposite to each other, whereby if the transfer belt 24 attempts to move in the edge direction, the left and right elastic fins 51*a* and 51*b* cause a force toward the center to act on the transfer belt 24.

Figure 8:
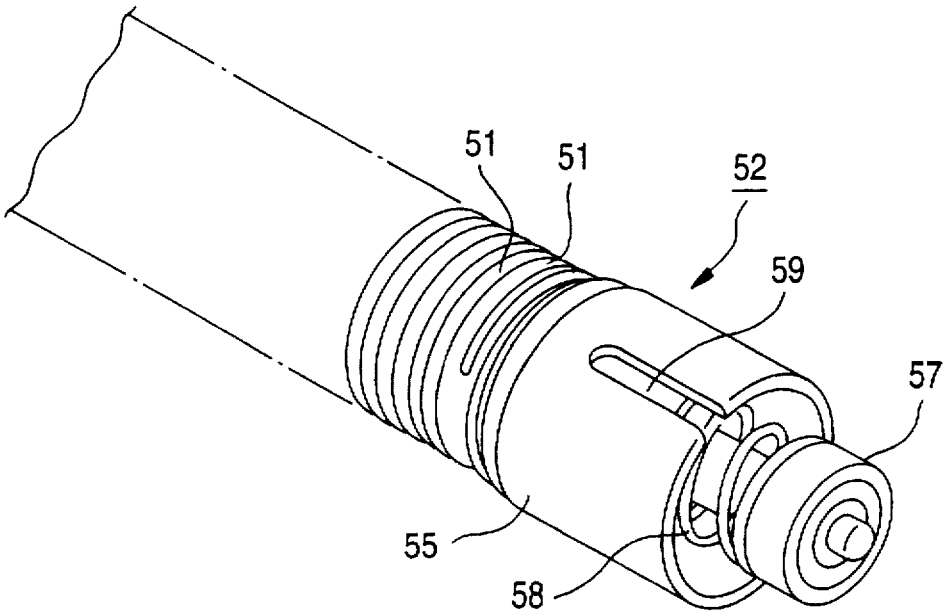
FIG. 8 is a perspective view to show a guide member.

The tension roller 27 is provided with guide members 52 called compliant guides for guiding the transfer belt 24 while allowing a predetermined amount of motion in the edge direction of the transfer belt 24. As shown in FIGS. 6 and 8, the guide members 52 are formed each like a cylindrical shape as its appearance and attached to both ends of the tension roller 27. As shown in FIG. 6, each of the guide members 52 comprises a pivotally supported part 53 formed like a cylindrical shape on the inner peripheral side and pivotally supported on the shaft member 50 of the tension roller 27, a flange part 54 projected outward in the radial direction from the axial inner end of the pivotally supported part 53, and an outer cylinder part 55 formed like a double cylindrical shape in parallel with the pivotally supported part from the outer peripheral end of the flange part 54. Further, a level difference part 56 that the end face of the transfer belt 24 abuts is formed of an annular metal member on the outer peripheral end of the flange part 54 of the guide member 52. Further, a ball bearing 57 for rotatably attaching the tension roller 27 is fitted into each end of the shaft member 50 of the tension roller 27. As shown in FIG. 6, a compression spring 58 intervenes between the ball bearing 57 and the inner face of the flange part 54 of the guide member 52 so as to always energize the guide member 52 toward the axial inner side of the tension roller 27. The energy of the compression spring 58 is set to a given value appropriately in response to the material, form, etc., of the transfer belt 24. In the figures, numeral 59 denotes a recessed groove being fitted in a projection (not shown) for stopping rotation of the guide member 52.

Figure 9:
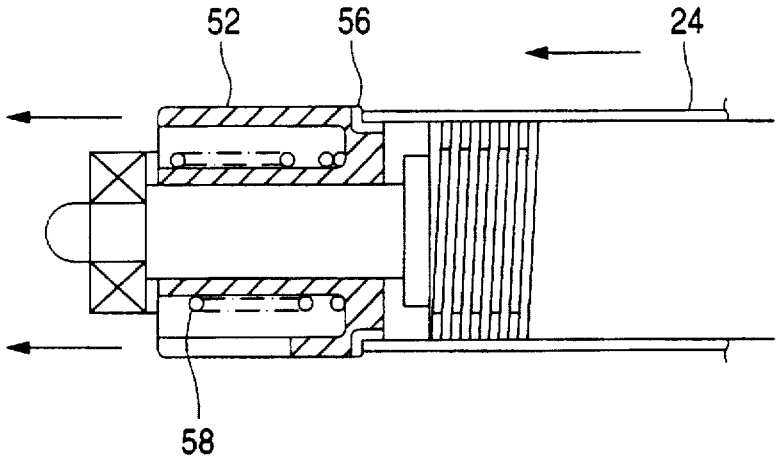
FIG. 9 is a sectional view to show the function of the guide member.

As shown in FIG. 9, the guide member 52 guides the transfer belt 24 with the end face of the transfer belt 24 abutting the level difference part 56 and when a force for moving the transfer belt 24 in the edge direction acts, the compression spring 58 of the guide member 52 absorbs the force; if the guide member 52 moves in the edge direction and the end face of the transfer belt 24 is incompletely shaped, the compression spring 58 absorbs It, preventing the transfer belt 24 from taking a belt walk.

Figure 10:
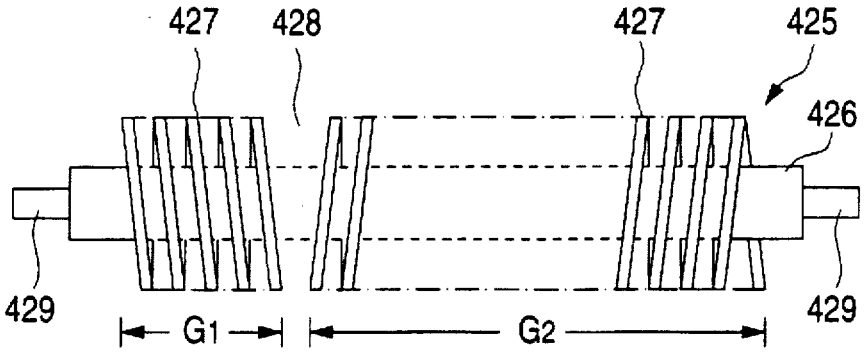
FIG. 10 is a front view to show a roller.

The LLF roller comprising the spiral elastic fin will be discussed in more detail. FIG. 10 shows a driven roller 425 used for any two of the stripping roller 26, the tension roller 27, or the idle roller 28 (in the example shown in FIG. 12, it is used for the tension roller 27 and the idle roller 28). This roller 425 comprises a spiral elastic fin 427, namely, a spiral fin erected along the axial direction of a rotating shaft 426. The spiral fin 427 consists of two spiral groups G1 and G2 different in winding direction around the rotating shaft 426, and a boundary 428 between the spiral groups G1 and G2 is not formed with the elastic fin 427 and provides a slight gap.

The boundary 428 is disposed in a position displaced in a shaft end direction from the axial center of the roller 425 and in the example shown in FIG. 10, the region of the spiral group G1 is set shorter than the region of the spiral group G2. However, both shaft ends 429 and 429 of the rotating shaft 426 of the roller 425 are worked in the same shape and to assemble the belt transporter, either shaft and 429 may be fitted into the front side (paper face front side in FIG. 2).

Figure 11:
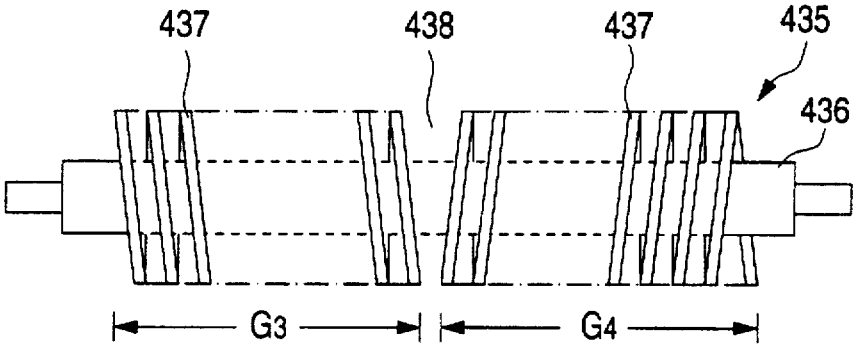
FIG. 11 is a front view to show a roller.

On the other hand, FIG. 11 shows a roller 435 of an LLF roller. This roller 435 also comprises a spiral fin 437 consisting of two spiral groups G3 and G4 erected on a rotating shaft 436. Unlike the roller 425, a boundary 438 between spiral groups G3 and G4 is formed at the axial center of the roller 435.

Figure 12:
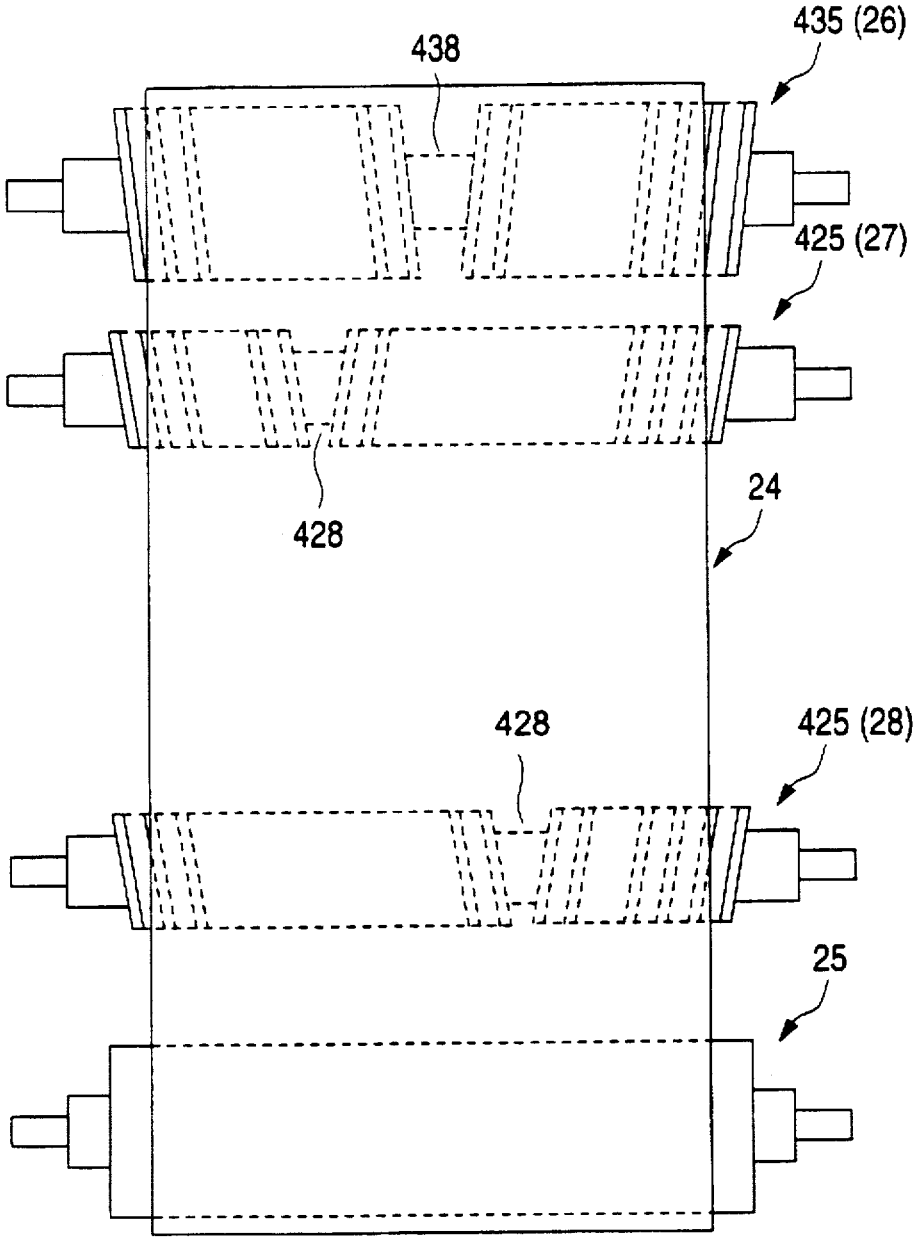
FIG. 12 is a plan view to show a belt transporter.

FIG. 12 is a plan view of the belt transporter in the Embodiment using the rollers 425 and the roller 435, wherein the guide members 52 attached to both ends of the roller 435 of an LLF roller are not shown.

As already described, the roller 435 shown in FIG. 11 is used as the LLF roller and the rollers 425 shown in FIG. 10 are used as simple driven rollers. The rollers 425 are disposed so that the positional relationship between the spiral groups G1 and G2 relative to the transfer belt 24 are opposed to each other. That is, the rollers 425 are disposed so as to distribute the boundaries made on the rollers left and right with respect to the center in the width direction of the transfer belt 24, whereby the walk force given by the spiral fin 427 of one roller 425 to the transfer belt 24 with the rotation of the roller 425 is balanced with that given by the spiral fin 427 of another roller 425 to the transfer belt 24 with the rotation of the roller 425, thus a belt walk caused by the rotation of the rollers 425 can be prevented. In the description made so far, the rollers 425 are used as simple driven rollers, but may be used as LLF rollers.

Since the roller 435 of an LLF roller has spiral groups G3 and G4 disposed left and right equally with respect to the center in the width direction of the transfer belt 24, thus the walk force given by the spiral fin 437 to the transfer belt 24 is balanced in left and right directions of the paper face in FIG. 12. Therefore, a belt walk caused by the rotation of the rollers 435 can also be prevented.

The reason why the boundary 438 is formed at the axial center of only the roller 435 of the LLF roller in the embodiment is that as described above with reference to FIG. 5, the LLF roller is used for the large lap angle θ portion of the transfer belt 24 with the roller and that the force of pressing the LLF roller and the transfer belt 24 against each other is large. That is, the spiral fin 437 of the LLF roller gives a large walk force to the transfer belt 24 as the force of pressing the LLF roller and the transfer belt 24 against each other is large. If the spiral groups G3 and G4 are formed asymmetrically with respect to the boundary 438, the transfer belt easily takes a belt walk. However, if the belt walk does not cause a problem in practical use, the roller 425 may be made of an LLF roller.

Further, from the viewpoint of reducing the walk force given by the spiral fin 427 to the transfer belt 24, the boundary 428 between the spiral groups G1 and G2 of the roller 425 should also be disposed at the center in the width direction of the transfer belt 24. In this case, however, the boundary 438 between the spiral groups of the LLF roller and the boundary 428 between the spiral groups of each of the two rollers 425 are aligned at the center in the width direction of the transfer belt 24, thus the transfer belt is dented in the positions and it is feared that a void may occur in the toner image transferred onto a record sheet at the image formation time.

In contrast, in the belt transporter in the embodiment shown in FIG. 12, the boundary 438 between the spiral groups of the roller 435 of the LLF roller and the boundary 428 between the spiral groups of each of the rollers 425 of driven rollers are placed in different positions in the width direction of the transfer belt 24, thus it is not feared that the transfer belt may be dented in specific positions and a void can be prevented from occurring in the toner image transferred onto a record sheet.

Figure 13:
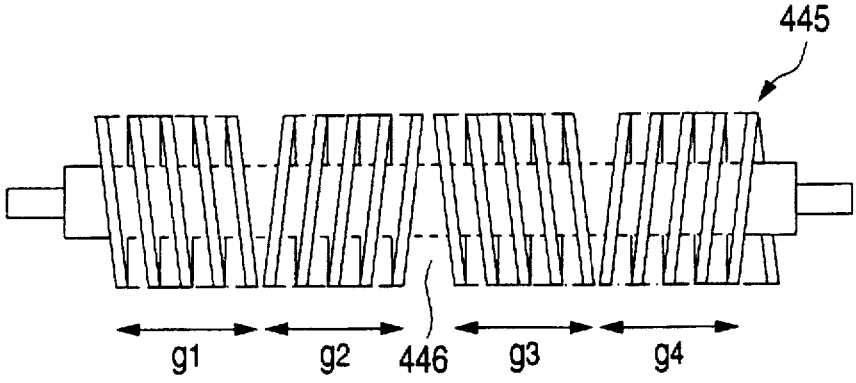
FIG. 13 is a front view to show another example of a roller.

In the embodiment, the roller used as the LLF roller may be a roller shown in FIG. 13. That is, as shown here, if a boundary 446 is disposed at the axial center of a roller 445 and spiral groups g1, g2, g3, and g4 are formed symmetrically with respect to the boundary 446, any number of spiral groups may be provided.

Figure 14:
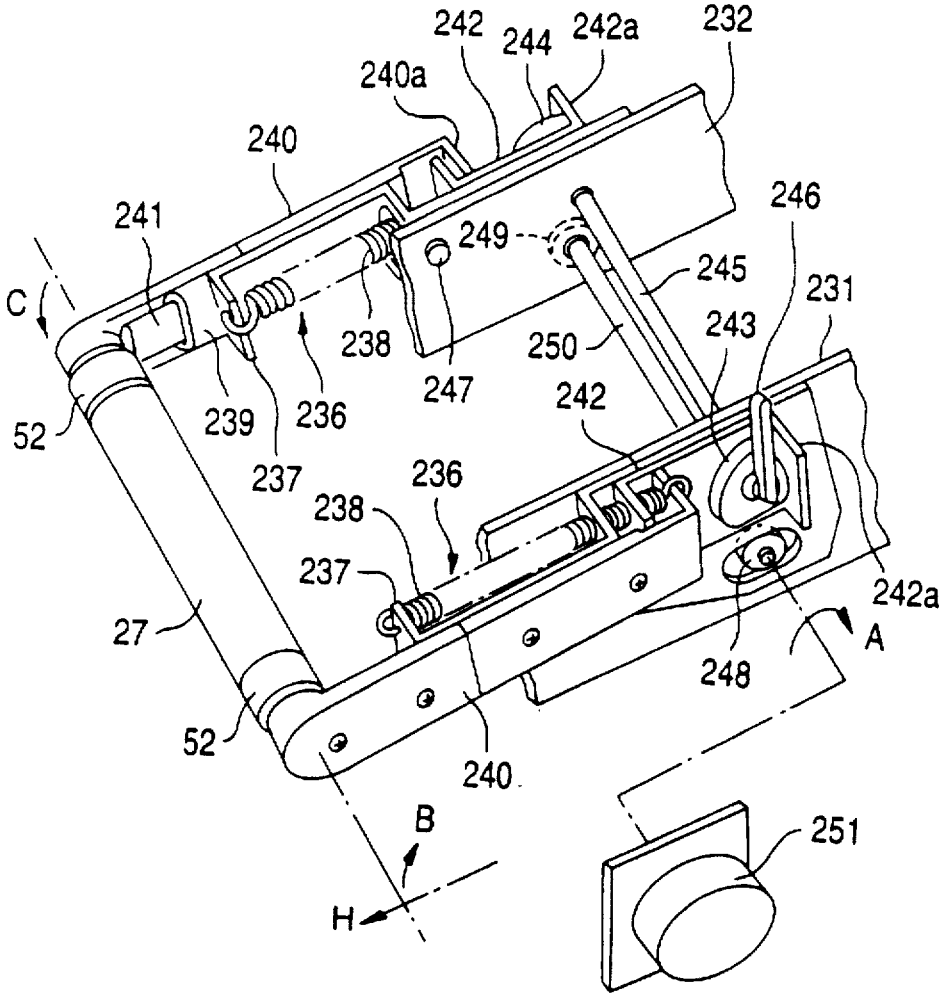
FIG. 14 is a perspective view to show a tension roller support mechanism.

FIG. 14 shows a mechanism for supporting the tension roller 27 so as to give a tension to the transfer belt. Tension giving mechanisms 236 are attached to a pair of front and rear belt frames 231 and 232 provided to attach the transfer belt 24. Each of the tension giving mechanisms 236 consists of a bracket 237 fixed to the belt frame 231, 232, a spring 238 fixed at one end to the inner tip of the bracket 237, and a slide rail (fixed side) 239 disposed on the outside of the bracket 237. Both ends of the tension roller 27 are pivotally supported on support arms 240 and a projection is made on the inner side of each support arm 240.

The projection 241 of the support arm 240 is fitted in the slide rail 239 and a tip 240*a* of the support arm 240 is fixed to the spring 238, whereby the support arm 240 is energized in the H direction in FIG. 14 by the elastic force of the spring 238, giving a predetermined tension to the transfer belt 24.

A release plate 242 is fixed at one end to the spring 238 on the tip 240*a* side of the support arm 240 and is formed at the other end with a curve part 242*a* against which a release cam 243, 244 is made to abut. These release cams 243 and 244 are attached to both ends of a cam shaft 245 passed through the belt frames 231 and 232; the release cam 243 on the side of the front belt frame 231 is provided with a release lever 246. According to the structure, when the release lever 246 is set as shown in FIG. 14, the support arm 240 is energized, giving a tension to the transfer belt. To replace the transfer belt, if the release lover 246 is tilted, the release plates 242 pull the support arms 240 against the springs 238, thereby releasing the tension acting on the transfer belt 24.

Further, each bracket 237 of the tension giving mechanism 236 is secured to the belt frame 231, 232 for pivotal movement about a stem 247 and belt move cams 248 and 249 for controlling pivotal movement of the brackets 237 are provided, making up a mechanism for inclining the shaft of the tension roller 27. The two belt move cams 248 and 249, which are attached to both ends of a cam shaft 250 passed through the belt frames 231 and 232, are placed so that when the cam shaft 250 rotates in the A direction in FIG. 14, for example, the front support arm 240 pivots in the B direction and the deep support arm 240 pivots in the C direction reverse to the B direction. The cam shaft 250 is rotated by a motor 251.

Figure 15:
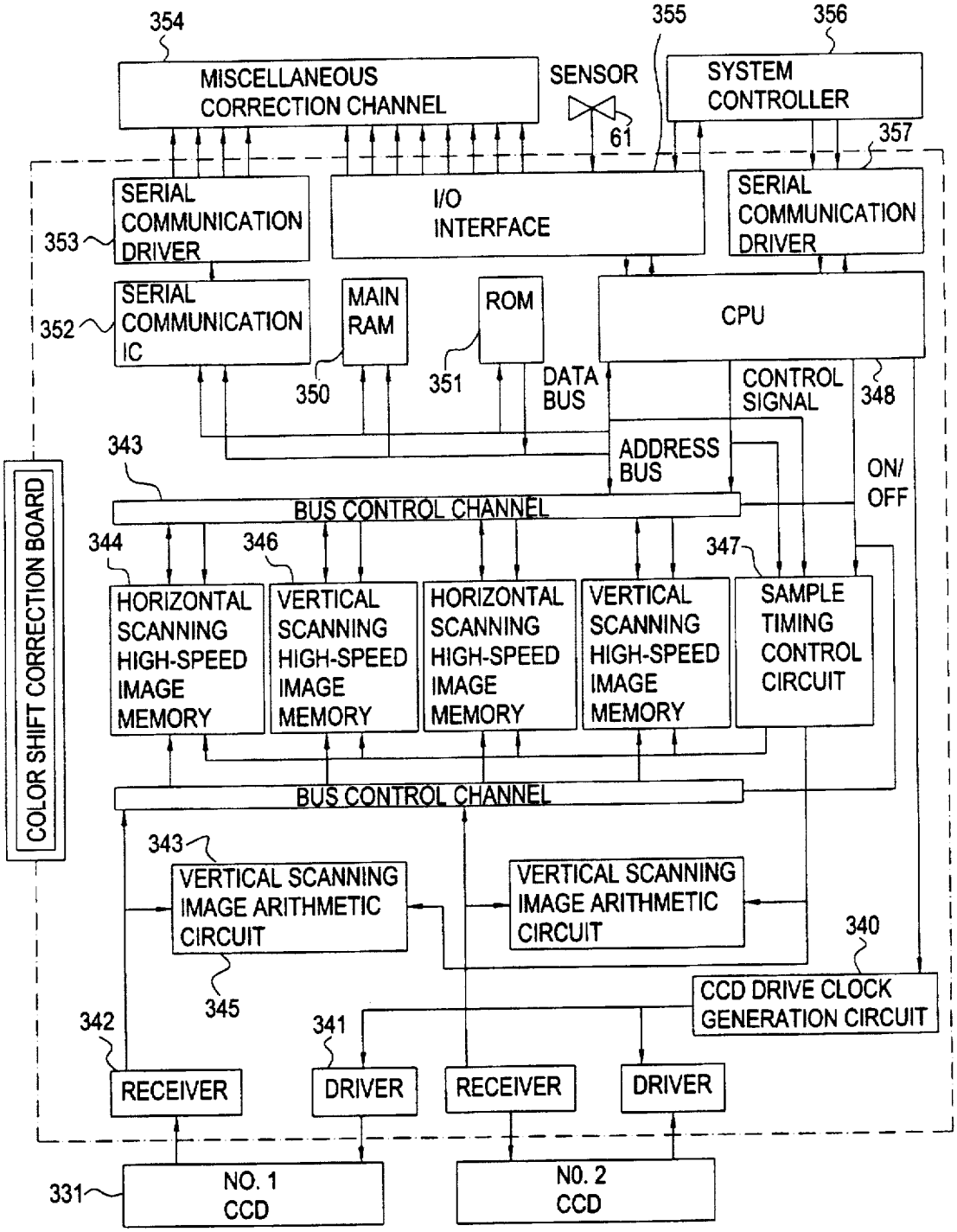
FIG. 15 is a block diagram to show a control section.

FIG. 15 is a block diagram to show one embodiment of a control section of the digital color copier. This control section is disposed in a color shift correction board. To clarify the drive control operation of the transfer belt, color shift correction blocks will also be covered in the description although they are not directly involved in transfer belt drive control.

In the color shift correction board, a driver 341 drives a CCD sensor 331 for detecting a color shift detection pattern (not shown) in response to a clock generated by a CCD drive clock generation circuit 340 for reading 8-bit, 256-gray-level read image data, for example, into a receiver 342 in sequence in pixel units. The image data concerning horizontal scanning is stored in a horizontal scanning high-speed image memory 344 through a bus control channel 343. The image data concerning vertical scanning is averaged by a vertical scanning image arithmetic circuit 345, then is stored in a vertical scanning high-speed image memory 346 through the bus control channel 343. A sampling timing control circuit 347 controls the timings at which image data is read into the vertical scanning image arithmetic circuit 345, the horizontal scanning high-speed image memory 344, and the vertical scanning high-speed image memory 346 in response to the sampling start timing, sampling period, etc., set in a CPU 348. A main RAM 350 is used as a work area of the CPU 348 and a ROM 351 is provided to store a CPU 348 control program, etc. A serial communication IC 352 and a serial communication driver 353 are provided for the CPU 348 to transmit control data of setup parameters, etc., to a miscellaneous correction channel 354. An I/O interface 355 is an interface between the CPU 348 and the miscellaneous correction channel 354, and a system controller 356 for outputting on/off signal to the miscellaneous correction channel 354 and inputting on/off signal from a sensor 61 and transferring on/off signal to and from the system controller 356. A serial communication driver 357 enables data transfer between the CPU 348 and the system controller 356.

Figure 16:
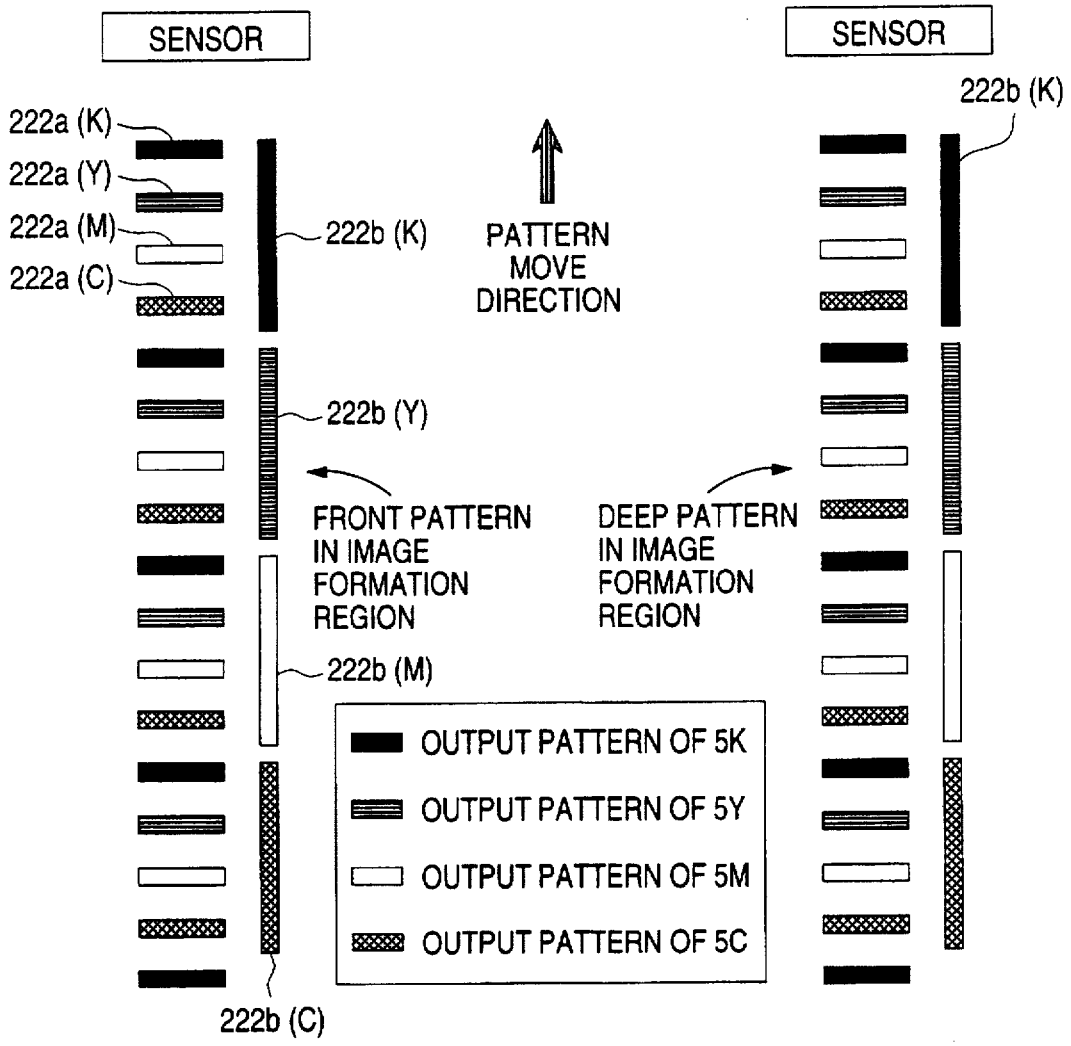
FIG. 16 is an illustration to show color registration adjustment patterns.

The CPU 348 controls the CCD drive clock generation circuit 340, the sampling timing control circuit 347, and the bus control channel 343, reads Image data of registration shift measurement patterns 222*a*(K), 222*a*(Y), 222*a*(M), 222*a*(C), 222*b*(K), 222*b*(Y), 222*b*(M) and 222*b*(C) as shown in FIG. 16 output onto the transfer belt 24, determines the image position address, calculates the registration shift amount, and controls the miscellaneous correction channel 354 through the serial communication IC 352 and the serial communication driver 353 or through the I/O interface 355 and the serial communication driver 357.

Figure 4:
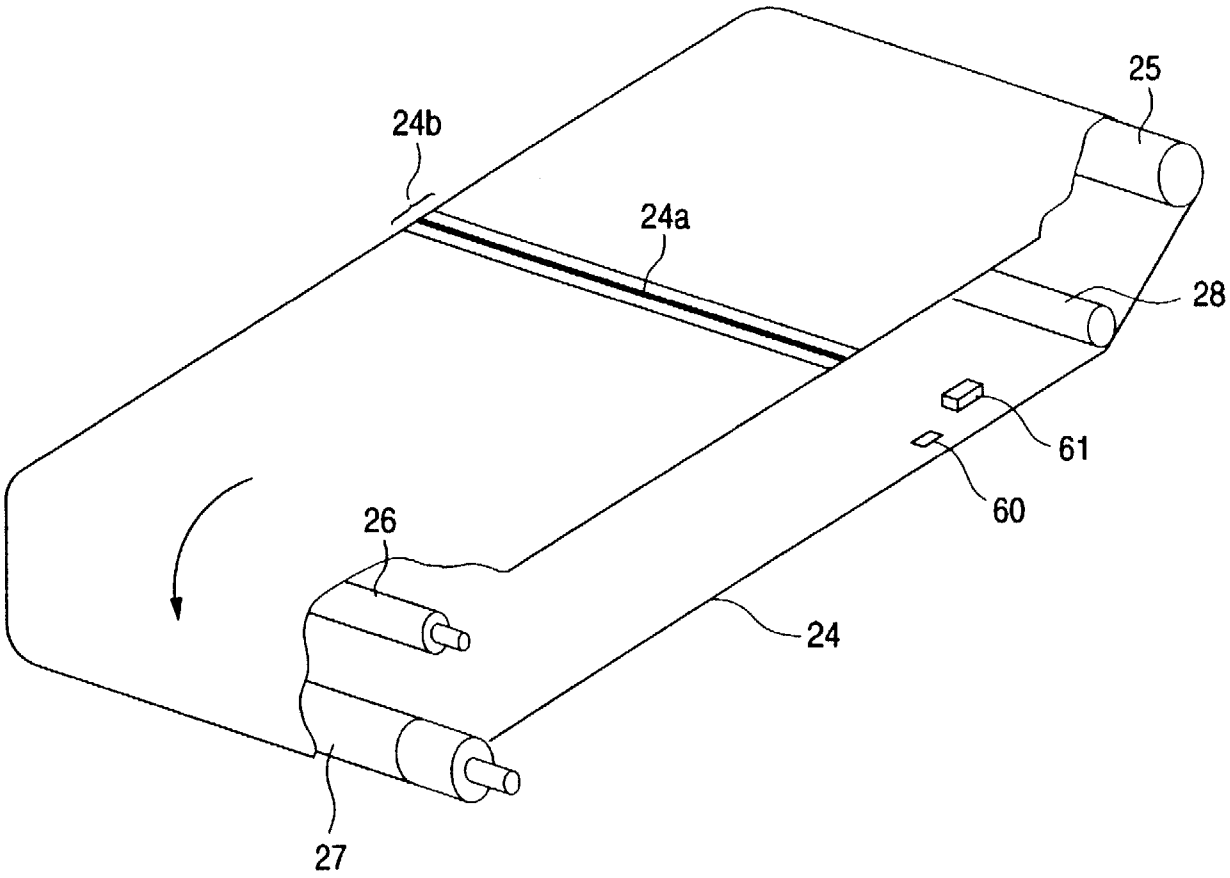
FIG. 4 is a partially broken away view in perspective of a support transport mechanism of a transfer belt of the digital color copier.

By the way, used as the transfer belt 24 circulated by the rollers including the tension roller 27 as described above is, for example, a belt shaped like an endless belt by forming a synthetic resin film of polyethylene terephthalate, polyvinylidene fluoride, etc., having flexibility like a band and connecting both ends of the synthetic resin film formed like a band by means of welding, etc. Thus, the transfer belt 24 contains a connection portion called a seam 24*a* resulting from connecting both ends of the synthetic resin film formed like a band by means of welding, etc., as shown in FIG. 4. Slight asperities exist on the surface of the seam 24a of the transfer belt 24 as compared with other portions of the belt and the transfer paper 14 cannot be transported in a condition in which it is kept flat. Thus, in the digital color copier, the seam 24a of the transfer belt 24 is sensed and a plurality of sheets of the transfer paper 14 are transported in a condition in which they are held in predetermined positions other than the seam 24a.

Figure 17:
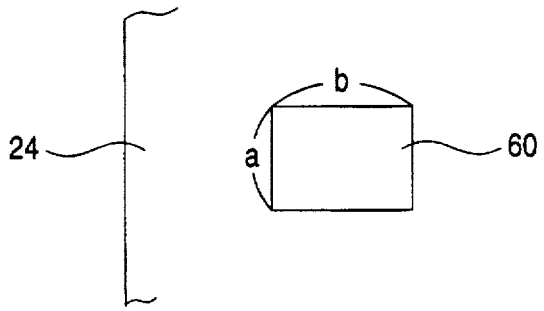
FIG. 17 is a plan view to show the proximity of a belt hole of the transfer belt.
Figure 18:
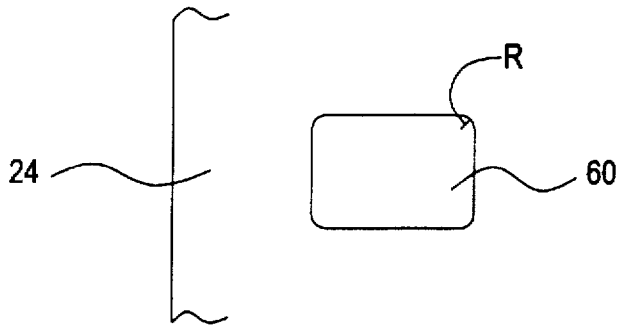
FIG. 18 is a plan view to show the proximity of a belt hole of the transfer belt.

That is, in the embodiment, as shown in FIG. 4, when the transfer paper 14 is held on the transfer belt 24, holding of the transfer paper 14 and transfer of a color image are inhibited in the seam 24a of the transfer belt 24 and an image formation inhibition area 24b having a predetermined width containing the seam 24a in the center portion. Thus, as shown in FIG. 4, a belt hole 60 as a seam detection mark for indirectly detecting the seam 24a is made upstream from the seam 24a along the move direction of the transfer belt 24. It is detected by the fact that light is not reflected from the belt hole 60. For example, as shown in FIG. 17, a rectangular opening (length a, width b) formed long in a direction perpendicular to the move direction of the transfer belt 24 is used as the belt hole 60. As shown in FIG. 18, the edge of the opening may also be shaped like R as the belt hole 60, in which case if a tension or compression force acts on the edge of the transfer belt 24, damage to the edge of the belt hole 60 can be prevented reliably. The seam detection mark is not limited to the belt hole 60 and a light reflection or transmission member may be disposed on the surface of the transfer belt, needless to say.

Figure 19A:
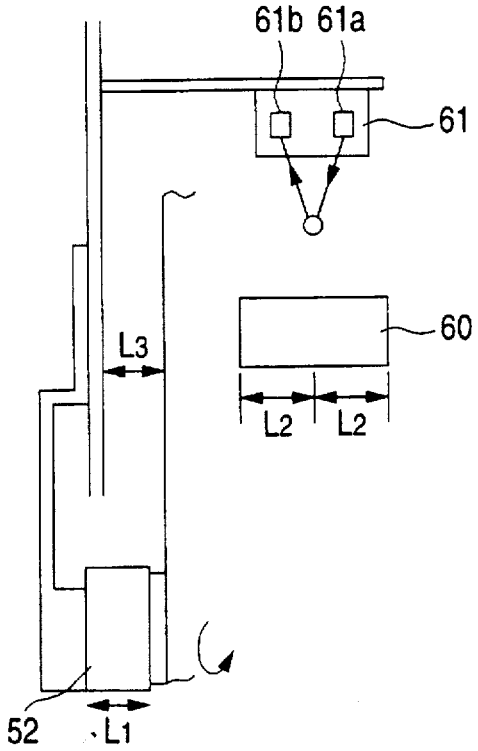
FIGS. 19A to 19D are illustrations to show a belt hole detection sensor of the transfer belt.

As shown in FIG. 4, a belt hole detection sensor 61 for detecting the belt hole 60 for seam detection is disposed upstream from the idle roller 28 on the circulating passage of the transfer belt 24. As shown in FIG. 19A, as the belt hole detection sensor 61, light is output from a light emitting element 61a and light reflected on the surface of the transfer belt 24 is sensed by a light receiving element 61b, thereby sensing the belt hole 60.

As shown in FIG. 19A, assuming that the maximum move distance of the guide member 52 located on both side ends of the tension roller 27 is L1, that a half of the length of the substantially rectangular belt hole 60 made in the end of the transfer belt 24 in a direction perpendicular to the forwarding direction of the transfer belt 24 is L2, and that a clearance between the belt end when the transfer belt 24 is positioned in the center of the transporter and the belt frame 231 for supporting the tension roller 27, etc., is L3, the belt hole 60 size, etc., is set so as satisfy L1>L2 and L3>L2, whereby whenever a belt walk occurs, the belt hole detection sensor 61 first senses the lateral move distance of the transfer belt 24 and the transfer belt 24 can be stopped.

Figure 19B:
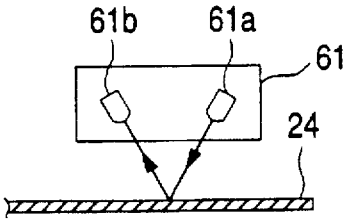
Figure 19C:
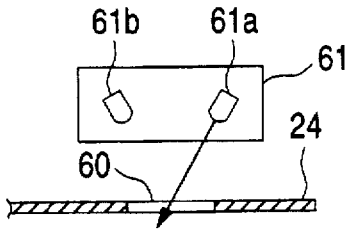
Figure 19D:
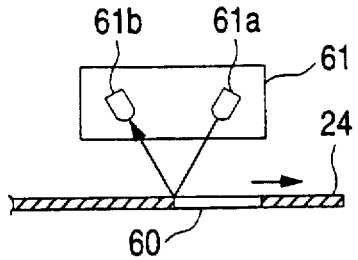
Figure 20:
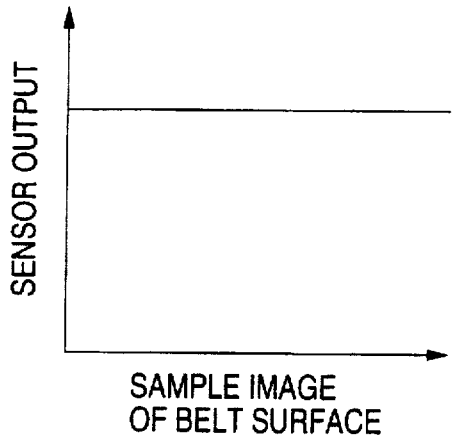
FIG. 20 is a graph to show output of the belt hole detection sensor.
Figure 21:
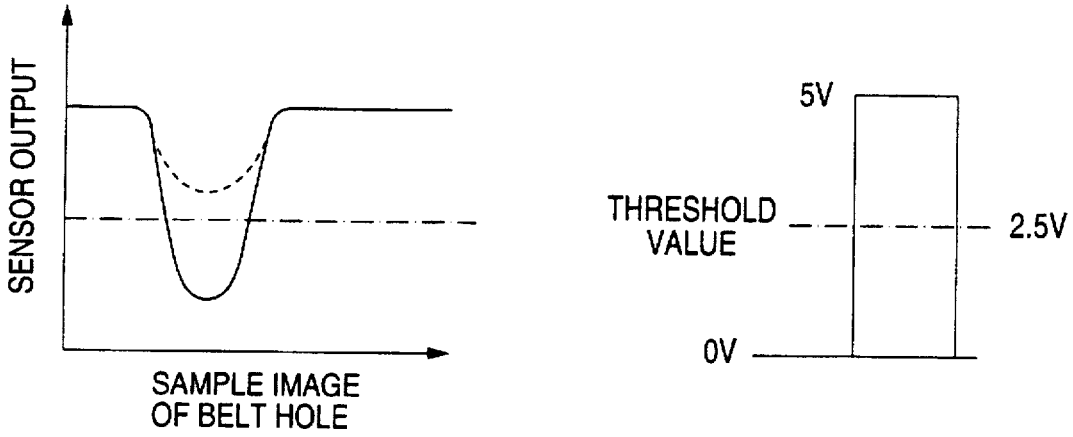
FIG. 21 is a graph to show output of the belt hole detection sensor.

When the surface of the transfer belt 24 passes through, reflected light is sensed by the light receiving element 61b of the belt hole sensor 61, as shown in FIG. 19B. On the other hand, when the belt hole 60 of the transfer belt 24 passes through, reflected light is not sensed by the light receiving element 61b, as shown in FIG. 19C, thus output of the belt hole detection sensor 61 lowers. Further, if the transfer belt 24 takes a belt walk and moves in the edge direction as shown in FIG. 19D, the amount of received light sensed by the light receiving element 61b, thus output of the sensor 60 increases as indicated by the broken line in FIG. 21. Therefore, a sensing signal of the belt hole 60 can be binarized by comparing the output of the sensor 60 with a predetermined threshold value as shown in FIG. 21.

As shown in FIG. 15, the binarized detection signal of the detection sensor 61 is input via the I/O interface 355 to the CPU 348, which then senses whether or not the transfer belt 24 is circulated in proper periods and whether or not the transfer belt 24 abnormally moves in the direction perpendicular to its forwarding direction based on the sensing signal from the detection sensor 61. If the CPU 348 has detected n times an abnormal move of the transfer belt 24 in the direction perpendicular to the forwarding direction regardless of whether the power is on or off, it stops the operation of the transporter.

Figure 22:
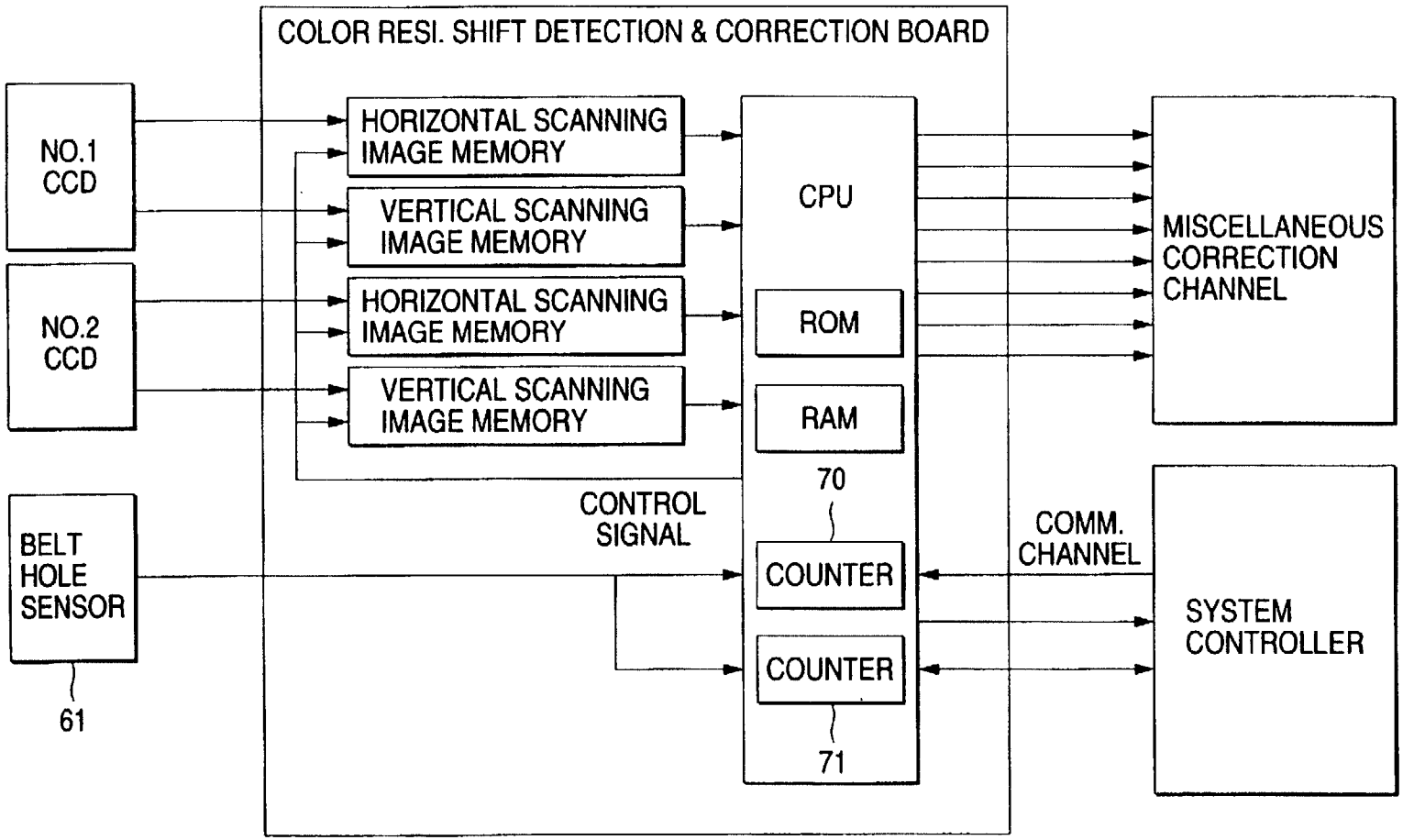
FIG. 22 is a block diagram to show a control section.
Figure 23:
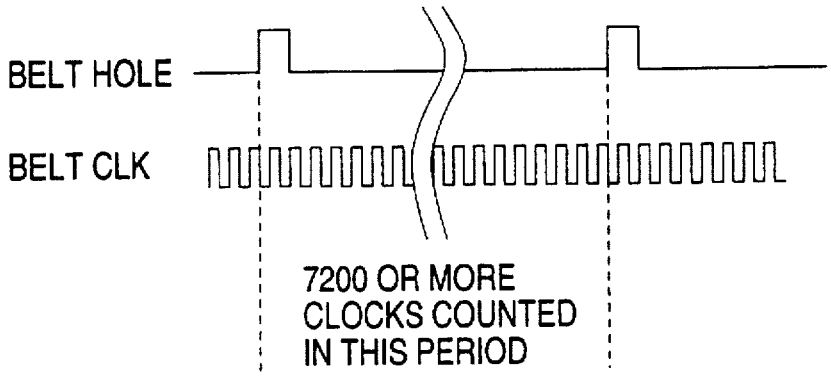
FIG. 23 is a timing chart to show the abnormal condition sensing operation of belt hole.
Figure 24:
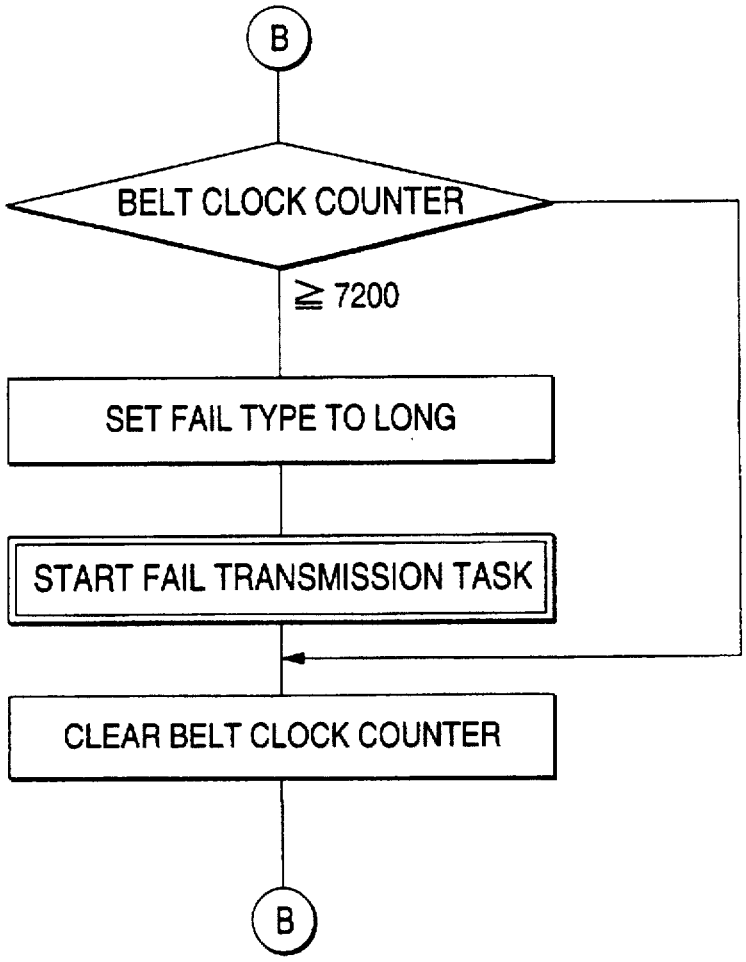
FIG. 24 is a flowchart to show the abnormal condition sensing operation of belt hole.

As shown in FIG. 22, the CPU 348 comprises counters 70 and 71 made of software to which the detection signal from the detection sensor 61 and a belt clock synchronized with the move speed of the transfer belt 24 are input. When a binarized sensing signal is input from the detection sensor 61, each of the counters 70 and 71 starts counting and always counts the number of belt clocks until input of another sensing signal from the detection sensor 61. As shown in FIG. 23, if the number of belt clocks counted between the detection signals output from the detection sensor 61 is a predetermined value (for example, 7200) or more, as shown in FIG. 24, the CPU 348 judges that the period of the belt hole 60 of the transfer belt 24 is too long, sets the fail type to Long, and starts a fail communication task, then clears the belt clock counters.

In addition to sensing only a case where the number of belt clocks is a predetermined value (for example, 7200) or more as the operation of the CPU 348, a case where the number of belt clocks is a predetermined value or less or where the number of belt clocks counted while the belt hole is sensed is a predetermined value or more may be sensed.

Figure 25:
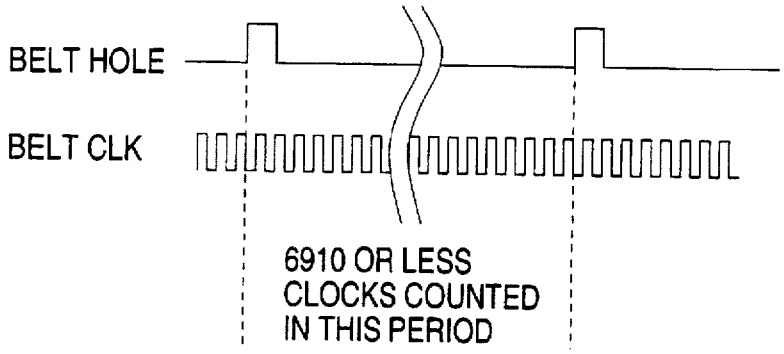
FIG. 25 is a timing chart to show the abnormal condition sensing operation of belt hole.
Figure 26:
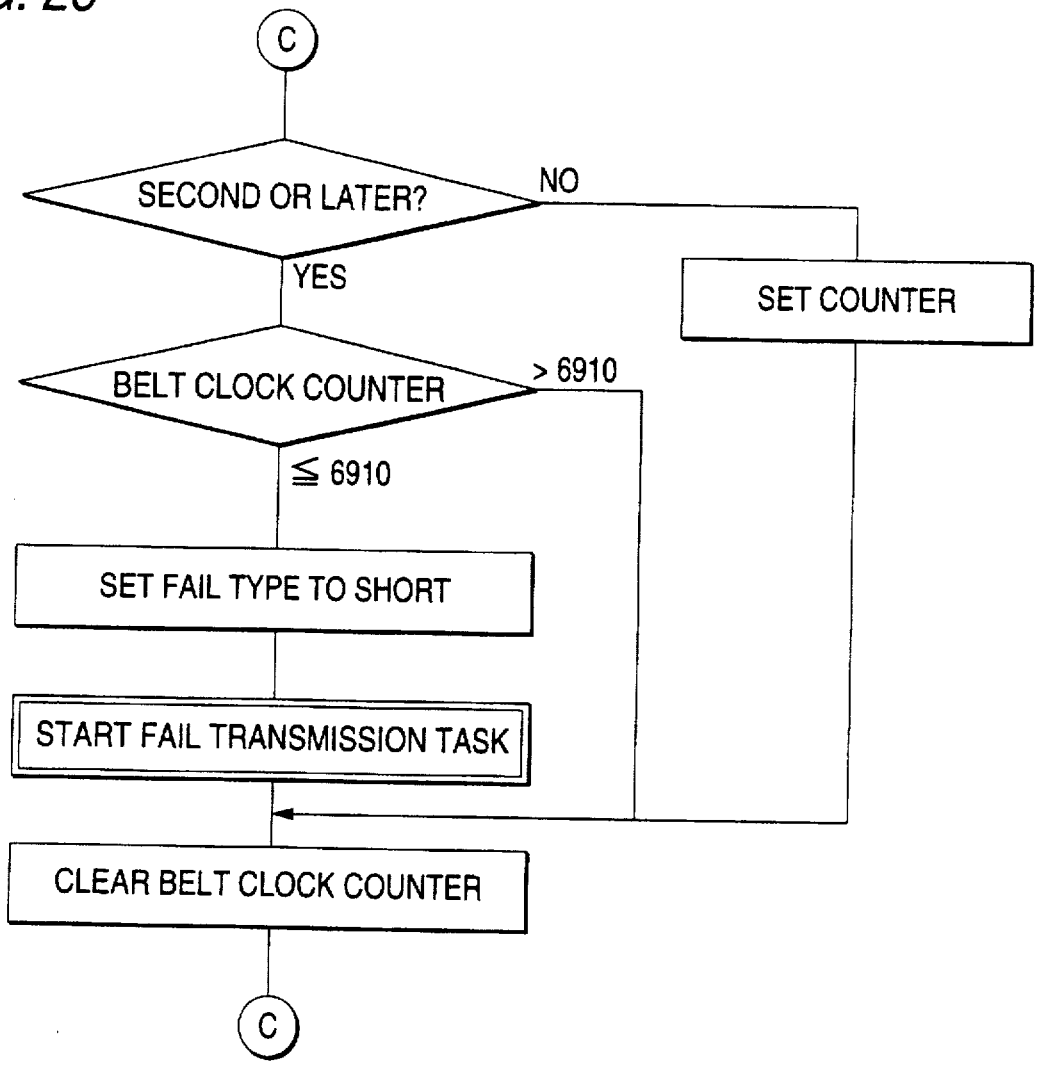
FIG. 26 is a flowchart to show the abnormal condition sensing operation of belt hole.

That is, if the number of belt clocks is a predetermined value or less as shown in FIG. 25, the CPU 348 checks whether or not the detection signal output from the detection sensor 61 is the second or later. If the detection signal is the second or later, the CPU checks whether or not the number of belt clocks counted between the detection signals output from the detection sensor 61 is a predetermined value (for example, 6910) or less. If the number of belt clocks is the predetermined value or less, as shown in FIG. 26, the CPU 348 judges that the interval of the belt hole of the transfer belt 24 is too short, sets the fail type to Short, and starts the fail communication task, then clears the belt clock counters. If the detection signal output from the detection sensor 61 is the first one, the CPU clears the belt clock counter.

Figure 27:
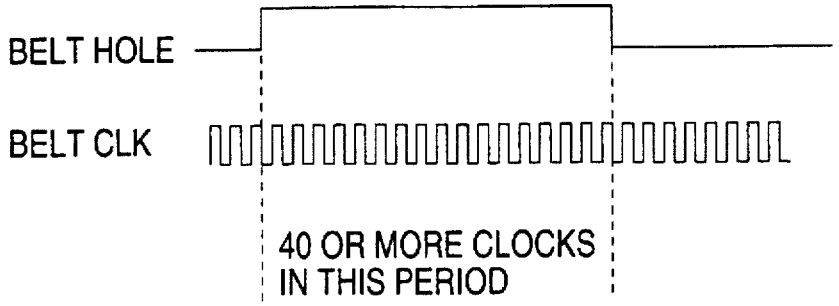
FIG. 27 is a timing chart to show the abnormal condition sensing operation of belt hole.
Figure 28:
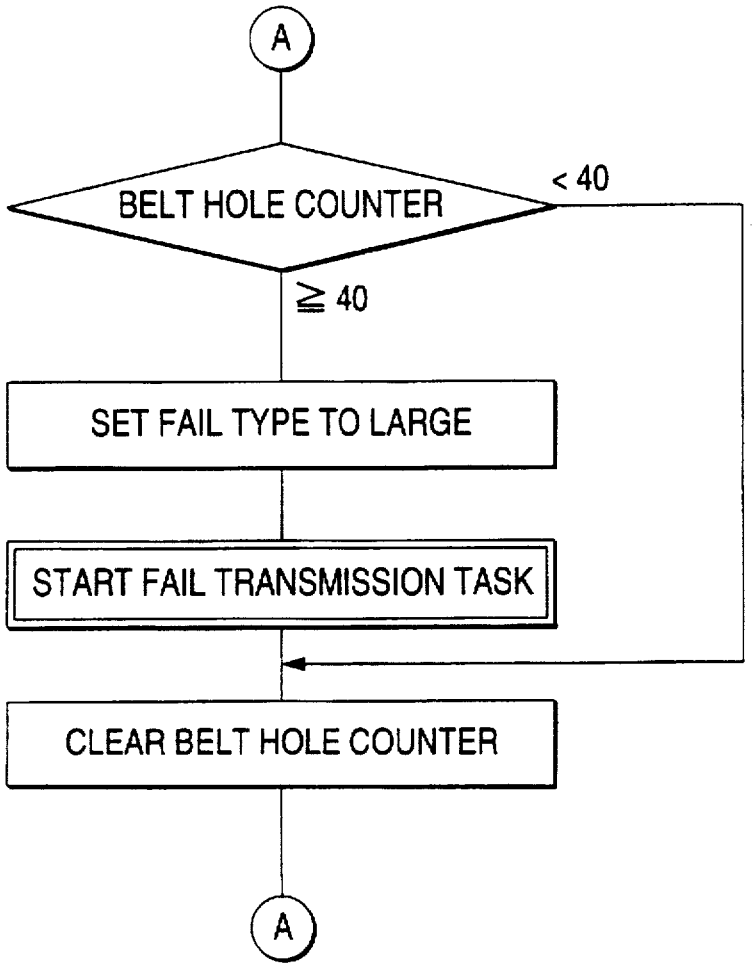
FIG. 28 is a flowchart to show the abnormal condition sensing operation of belt hole.

On the other hand, as shown in FIG. 27, if the number of belt clocks counted by belt hole counter while the detection sensor 61 senses the belt hole is a predetermined value (for example, 40) or more, as shown in FIG. 28, the CPU 348 judges that the belt hole of the transfer belt 24 is too long, sets the fail type to Large, and starts a fail communication task, then clears the belt hole counter.

Figure 29:
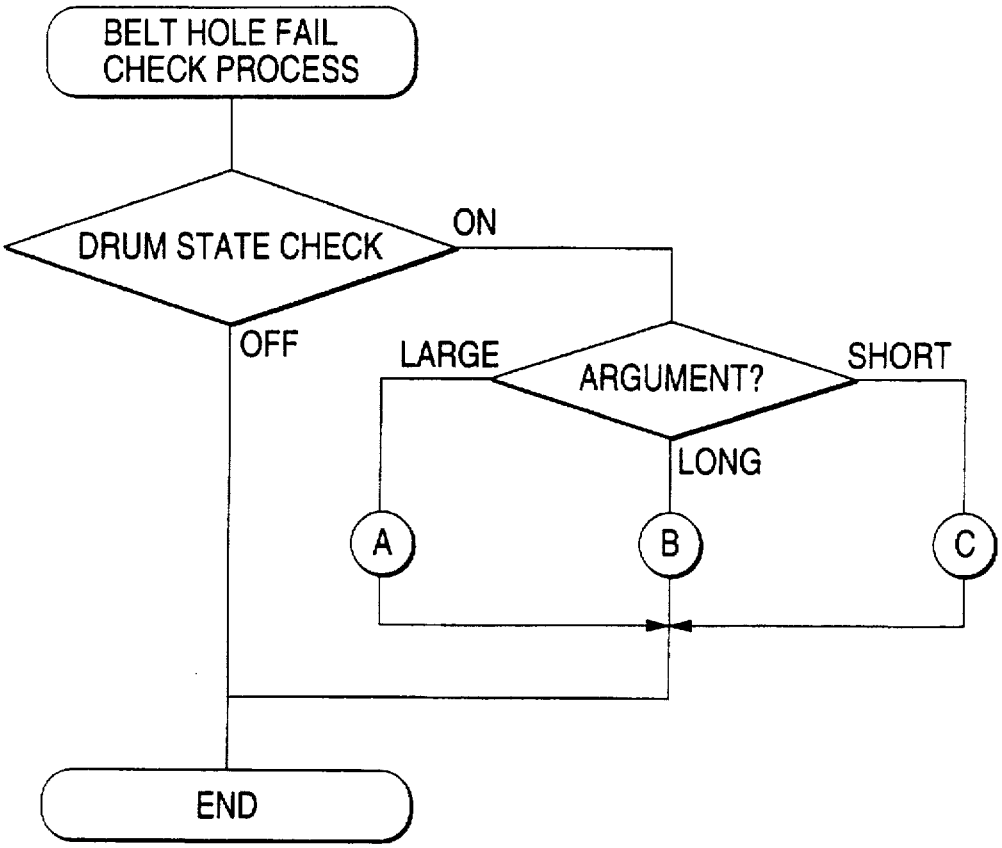
FIG. 29 is a flowchart to show the abnormal condition sensing operation of belt hole.

The belt hole fail check process associated with the belt clock count is performed only when the photosensitive drum rotates, namely, the drum state is ON; it is not performed when the drum state is OFF. Thus, as shown in FIG. 29, when performing the belt hole fail check process, the CPU checks whether the drum state is ON or OFF and only when the drum state is ON, executes the belt hole fail check process. The type of belt hole fail check process is selected by determining a preset "argument," but some or all of the check process types may be executed as required.

The CPU 348 determines the fail type by the fail communication task and performs the control operation in response to the determined fail type. To perform only the Long fail process, as shown in FIG. 23, the CPU 348 determines whether or not the number of clocks counted between the detection signals output from the detection sensor 61 is a predetermined value (for example, 7200) or more whenever the drum state is ON. If the number of belt clocks counted between the detection signals output from the detection sensor 61 is the predetermined value (for example, 7200) or more, as shown in FIG. 24, the CPU 348 judges that the period of the belt hole 60 of the transfer belt 24 is too long, sets the fail type to Long, and starts the fail communication task, then clears the belt clock counters.

A message to the effect that the service engineer should be called for repair because of a transport error of the transfer belt 24 is displayed on a display section of the digital color copier and moving the transfer belt 24 is stopped.

The number of times a transport error of the transfer belt 24 has occurred is stored in a nonvolatile memory and remains stored therein if the power is turned off.

Although a message to the effect that the service engineer should be called for repair because of a transport error of the transfer belt 24 is displayed, if the user once turns off the power, again turns on the power, and initializes the operation state for restarting color image formation without calling the service engineer, the CPU 348 forcibly stops the transfer belt 24 when it has sensed n (for example, n=3) times an abnormal move of the transfer belt 24 in the direction perpendicular to the forwarding direction regardless of whether the power is on or off.

Thus, when the CPU has sensed three times an abnormal move of the transfer belt 24 in the direction perpendicular to the forwarding direction based on the sensing signal output from the belt hole detection sensor 61, it displays a message to the effect that the service engineer should be called for repair and stops the transfer belt 24 for disabling the color image formation operation. This step of stopping the transfer belt 24 for disabling the color image formation operation is maintained although the power is turned on/off.

Thus, if an abnormal move of the transfer belt 24 in the direction perpendicular to the forwarding direction occurs, the digital color copier according to the embodiment reliably prevents damage such as buckling or a fracture from occurring at the end of the transfer belt in a simple structure at low costs as follows:

In the digital color copier, the transfer belt 24 is placed on the drive roller 25, the stripping roller 26, the tension roller 27, and the idle roller 28, and is circulated at a predetermined speed in the arrow direction by the drive roller 25 rotated by the dedicated motor (not shown) having an excellent constant speed property. While the transfer belt 24 transports the transfer paper 14 with the transfer paper 14 held on the surface of the transfer belt 24, toner images formed by the black, yellow, magenta, and cyan color image formation units 5K, 5Y, SM, and 5C are transferred onto the transfer paper 14 in sequence, thereby copying a color image. At the time, the transfer belt 24 moves only along the forwarding direction and does not move in the width direction in the normal state.

Figure 37A:
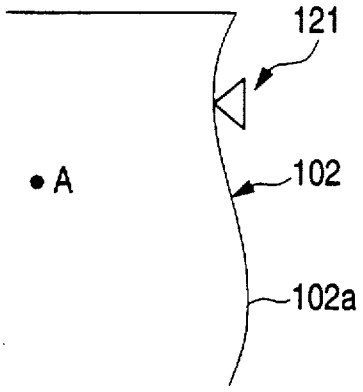
FIG. 37A (RELATED ART)
FIGS. 37A and 37B are illustrations to show conventional belt walk occurrence principles.
Figure 37B:
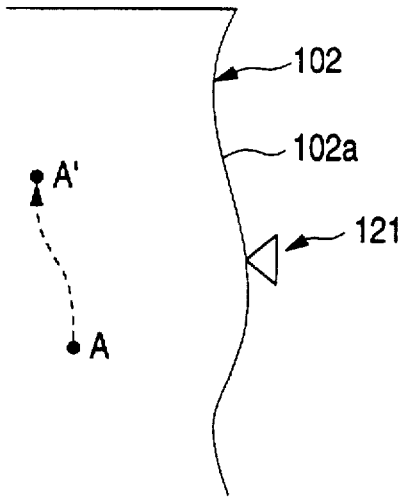
FIG. 37B (RELATED ART)

In the digital color copier, as shown in FIGS. 6 and 9, guide members 52 for guiding the transfer belt 24 while allowing a predetermined amount of motion in the edge direction of the transfer belt 24 are disposed on the ends of the tension roller 27. Thus, the guide members 52 can absorb a belt walk caused by the incomplete shaping of the transfer belt end face as shown in FIGS. 37A and 37B and buckling, a fracture, etc., can be prevented from occurring at the end of the transfer belt 24.

However, in the digital color copier, if a foreign substance of dust, dirt, etc., is deposited on the surface of any of the rollers on which the transfer belt 24 is placed for driving the transfer belt 24 and the outer diameter of the roller partially changes, or plastic deformation of the rollers, uneven abrasion, or the like occurs or the rollers on which the transfer belt 24 is placed are partially out of parallelism because of time-varying change with long-term use of the color copier, the belt walk distance of the transfer belt abnormally increases, the transfer belt 24 greatly displaces the guide member 52 to one side, the end of the transfer belt 24 comes in contact with the members such as the belt frames 231 and 232 for placing the transfer belt 24 thereon as shown in FIG. 14, buckling or a fracture occurs at the edge of the transfer belt 24, and the transfer belt 24 runs onto the guide member 52 and is stretched; the transfer belt 24 becomes unserviceable.

Then, in the embodiment, the fact that the belt walk distance of the transfer belt 24 abnormally increases is sensed based on the sensing signal of the belt hole 60 and immediately the transfer belt 24 is stopped.

That is, the CPU 348 determines the fail type by the fail communication task and performs the control operation in response to the determined fail type. If the CPU 348 senses an abnormal increase in the belt walk distance of the transfer belt 24 based on the sensing signal from the detection sensor 61, it displays a message to the effect that the service engineer should be called for repair because of a transport error of the transfer belt 24 on the display section of the digital color copier and stops moving the transfer belt 24.

The number of times a transport error of the transfer belt 24 has occurred is stored in the nonvolatile memory and remains stored therein if the power is turned off.

Although a message to the effect that the service engineer should be called for repair because of a transport error of the transfer belt 24 is displayed, if the user once turns off the power, again turns on the power, and initializes the operation state for restarting color image formation without calling the service engineer, the CPU 348 forcibly stops the transfer belt 24 when it has sensed n (for example, n=3) times an abnormal move of the transfer belt 24 in the direction perpendicular to the forwarding direction regardless of whether the power is on or off. The number of times a transport error of the transfer belt 24 has been sensed before the transfer belt 24 is forcibly stopped is not limited to three and may be set to one, two, or four or more, needless to say.

Thus, when the CPU has sensed three times an abnormal move of the transfer belt 24 in the direction perpendicular to the forwarding direction based on the sensing signal output from the belt hole detection sensor 61, it displays a message to the effect that the service engineer should be called for repair and stops the transfer belt 24 for disabling the color image formation operation. This step of stopping the transfer belt 24 for disabling the color image formation operation is maintained although the power is turned on/off. Even if the belt walk distance of the transfer belt 24 abnormally increases, an accident can be avoided wherein the edge of the transfer belt 24 comes in contact with the belt frame, 231, 232, etc., and buckling, a fracture, or the like occurs at the edge of the transfer belt 24, making the transfer belt 24 unserviceable.

Figure 30:
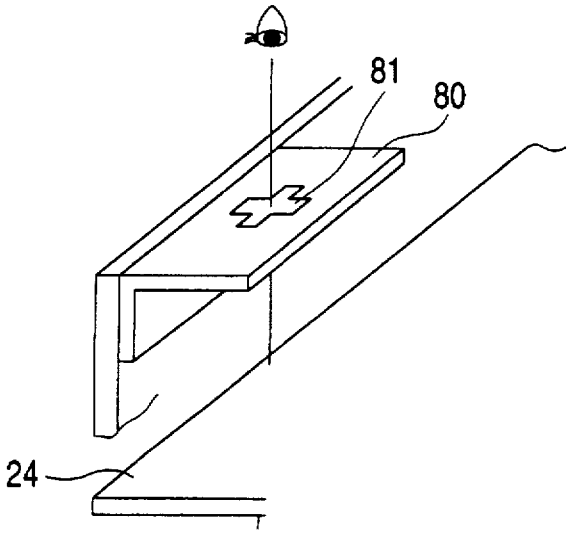
FIG. 30 is a perspective view to show a jig for adjusting the edge position of the transfer belt.
Figure 31:
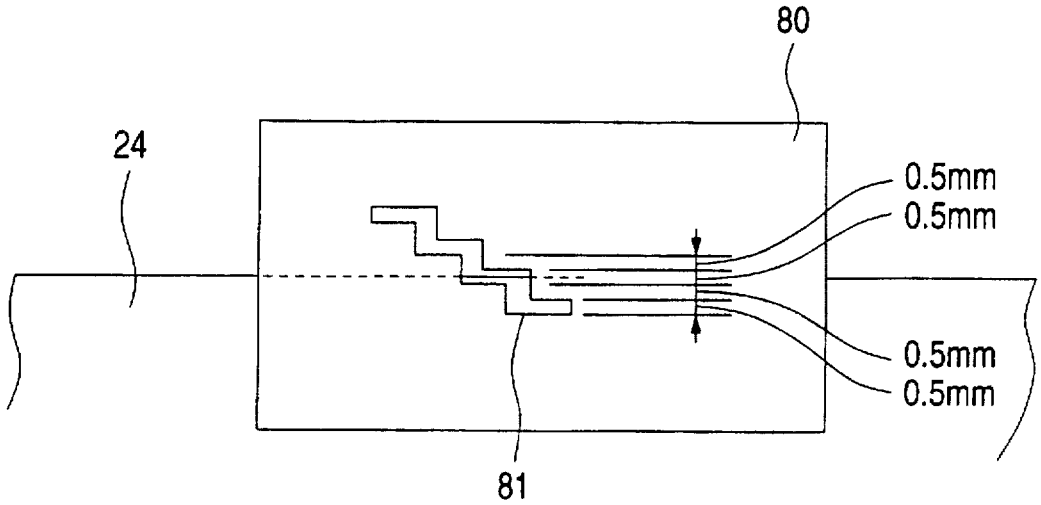
FIG. 31 is a perspective view to show a jig for adjusting the edge position of the transfer belt.

When the service engineer is called, he or she sets the digital color copier to a self-diagnosis mode for adjusting roller alignment, etc., so that the belt walk distance of the transfer belt 24 falls below a predetermined value. In the self-diagnosis mode, the transfer belt 24 is turned a predetermined number of times, m times, then stopped at a given position, and the belt walk distance of the transfer belt 24 is measured. At the time, a belt walk adjustment jig 80 as shown in FIG. 30 is attached to the belt frame 231, etc., for supporting the transfer belt 24. A cross-shaped opening 81 having a predetermined opening width is made in the belt walk adjustment jig 80. When the service engineer visually checks the end of the transfer belt 24 through the opening 81 of the jig 80, if the end of the transfer belt 24 is entered within the opening 81 of the jig 80, the belt walk amount of the transfer belt 24 is adjusted to the predetermined value or less. The belt walk adjustment jig 80 may be disposed on the outer or inner peripheral side of the transfer belt 24. A jig having an opening 81 as shown in FIG. 31 may be used as the belt walk adjustment jig 80. It is formed with a 0.5-mm step level difference part and the position of the end of the transfer belt 24 can be measured in 0.5-mm steps.

Embodiment 2

Figure 32:
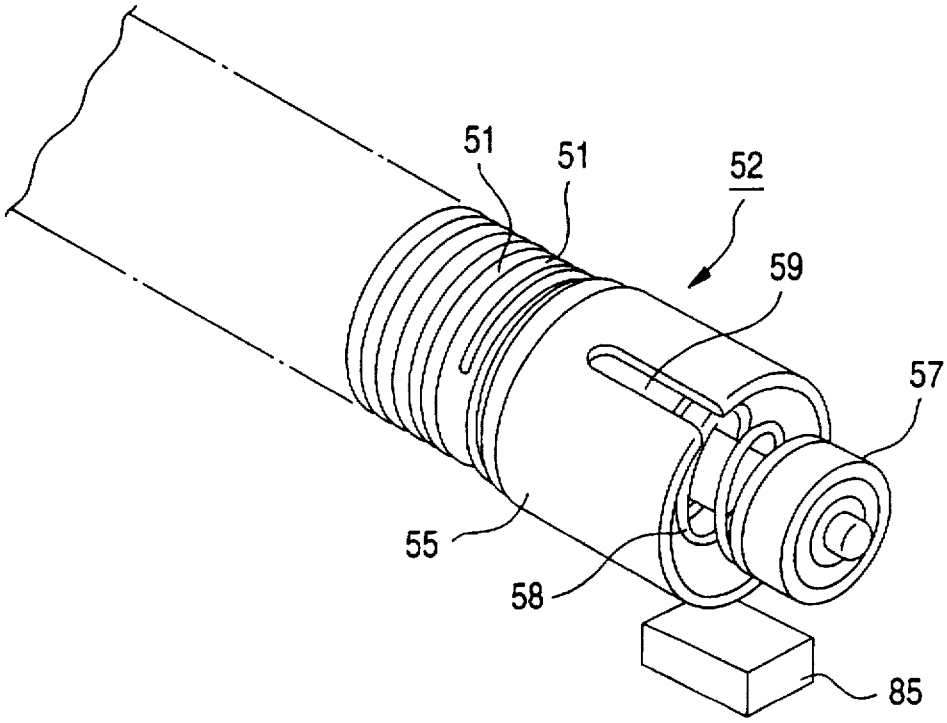
FIG. 32 is a perspective view to show an end of a guide member according to another embodiment of the invention.

FIG. 32 shows a second embodiment of the invention. Parts identical with those previously described in the first embodiment are denoted by the same reference numerals in FIG. 32. In the second embodiment, the position of a guide member is detected, thereby sensing an abnormal belt walk distance of the transfer belt 24.

That is, in the embodiment, as shown in FIG. 32, a detection sensor 85 for sensing that a guide member 52 of a tension roller 27 has moved in the edge direction a predetermined distance or more is provided.

In doing so, if a transfer belt 24 is not formed with a seam 24*a*, an abnormal belt walk distance of the transfer belt 24 can be sensed.

The second embodiment is similar to the first embodiment in other parts and functions and therefore their description is omitted.

Embodiment 3

Figure 33:
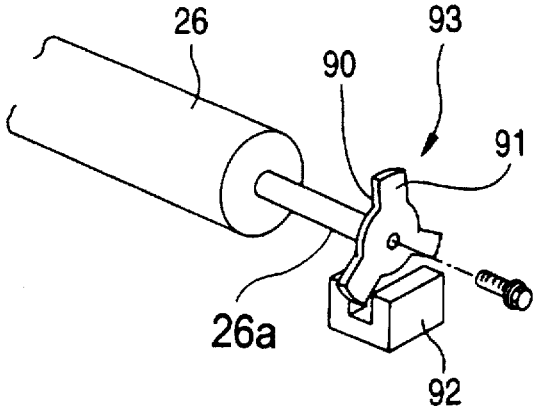
FIG. 33 is a perspective view to show an end of an idle roller according to still another embodiment of the invention.
Figure 34:
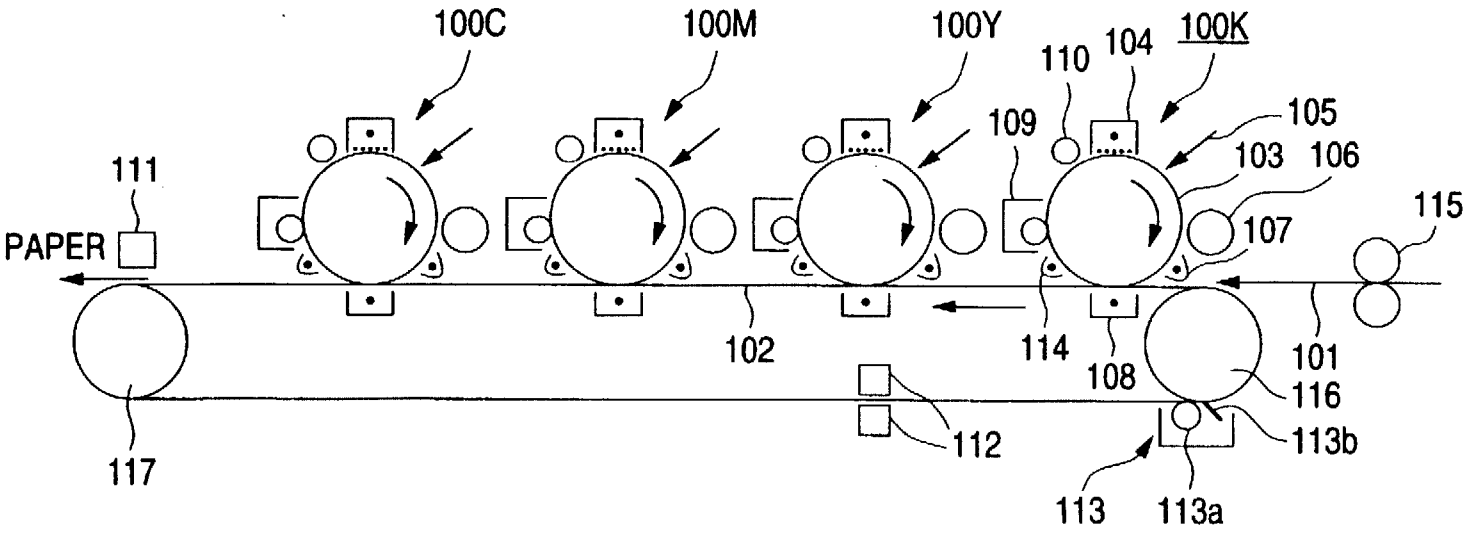
FIG. 34 is a drawing to show the structure of a conventional color image forming apparatus.
Figure 35:
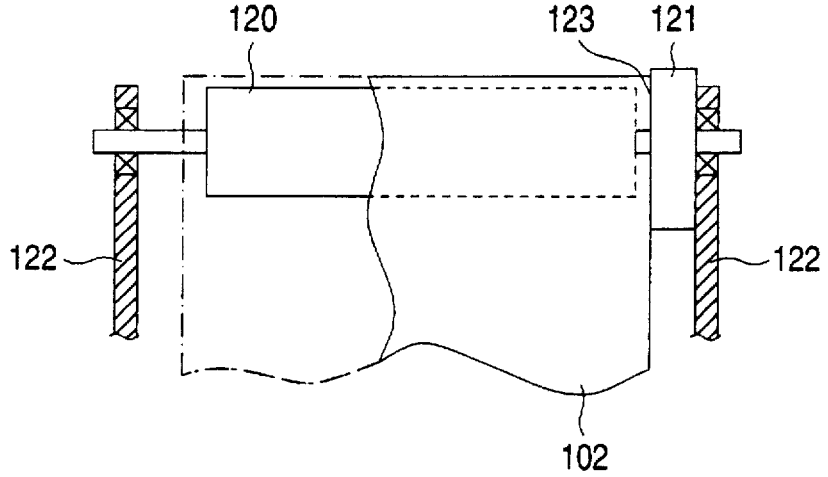
FIG. 35 (RELATED ART)
FIG. 35 is a drawing to show the structure of a conventional belt walk prevention device.
Figure 36A:
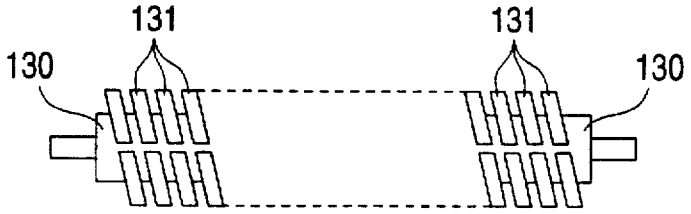
FIG. 36A (RELATED ART)
FIGS. 36A and 36B are a front view and a side view to show a conventional belt walk prevention device.
Figure 36B:
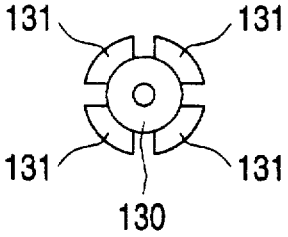
FIG. 36B (RELATED ART)

FIG. 33 shows a third embodiment of the invention. Parts identical with those previously described in the first embodiment are denoted by the same reference numerals in FIG. 33. In the third embodiment, any one driven roller of support rollers for supporting a transfer belt 24 is provided at one end with rotation sensing unit for sensing whether or not the driven roller rotates.

That is, in the embodiment, as shown in FIG. 33, a light shield plate 91 having a slit 90 is attached to an end of a rotating shaft 26*a* of a stripping roller 26 and rotation sensing unit 93 made of a transmission-type photosensor 92 for sensing the slit 90 of the light shield plate 91 is provided.

In this structure, if the transfer belt 24 should be broken because of the life of the transfer belt 24, etc., the rotation sensing unit 93 can rapidly sense that the stripping roller 26 has stopped. Thus, an accident wherein as the belt hole sensor 61 senses that the transfer belt 24 is broken in the first embodiment, breaking of the transfer belt 24 cannot be sensed until the transfer belt 24 makes one turn, and the transfer belt 24 is subjected to charge of a corotron, etc., and becomes damaged or may be burnt can be prevented.

By the way, the color copier of the embodiment has a frame to enable a transfer belt, etc., to be moved so that when transfer paper is jammed, it can be removed.

Figure 38:
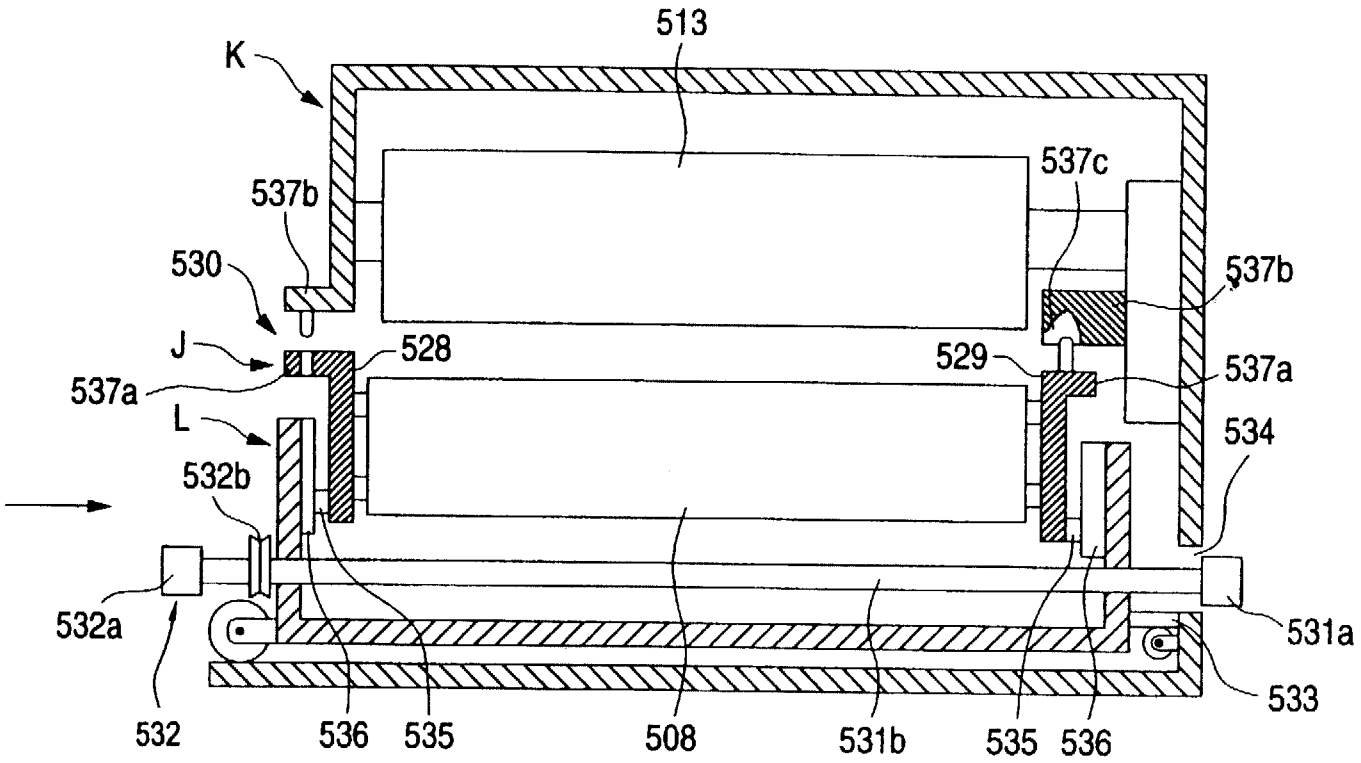
FIG. 38 is a main part sectional view of a color copier (when a roller frame moves down)

Specifically, as shown in FIG. 38, the frame is made up of a roller frame J on which a transfer belt 508 and four belt support rollers 518–521 (FIG. 47) are disposed, a main frame K on which four stations D–G, etc., are disposed, and a drawer L for supporting the roller frame J movably up and down and being slidable in the main frame K.

If the transfer belt 508 is dropped, the stations D–G can be operated independently so that the drive state of photosensitive bodies (represented by photosensitive drum 513) at the stations D–G and the discharge state of a charge corotron can be grasped. On the other hand, if the transfer belt 508 is dropped, there is a possibility that the positional interrelationships among the belt support rollers 518–521 may change, thus the transfer belt 508 is disabled from being driven. If the transfer belt 508 is dropped, power of fixing unit 31 (FIG. 2) is also turned off.

In the description that follows, the side where the drawer is slid and drawn will be the front (side) and its opposite side will be the rear (side).

Figure 39:
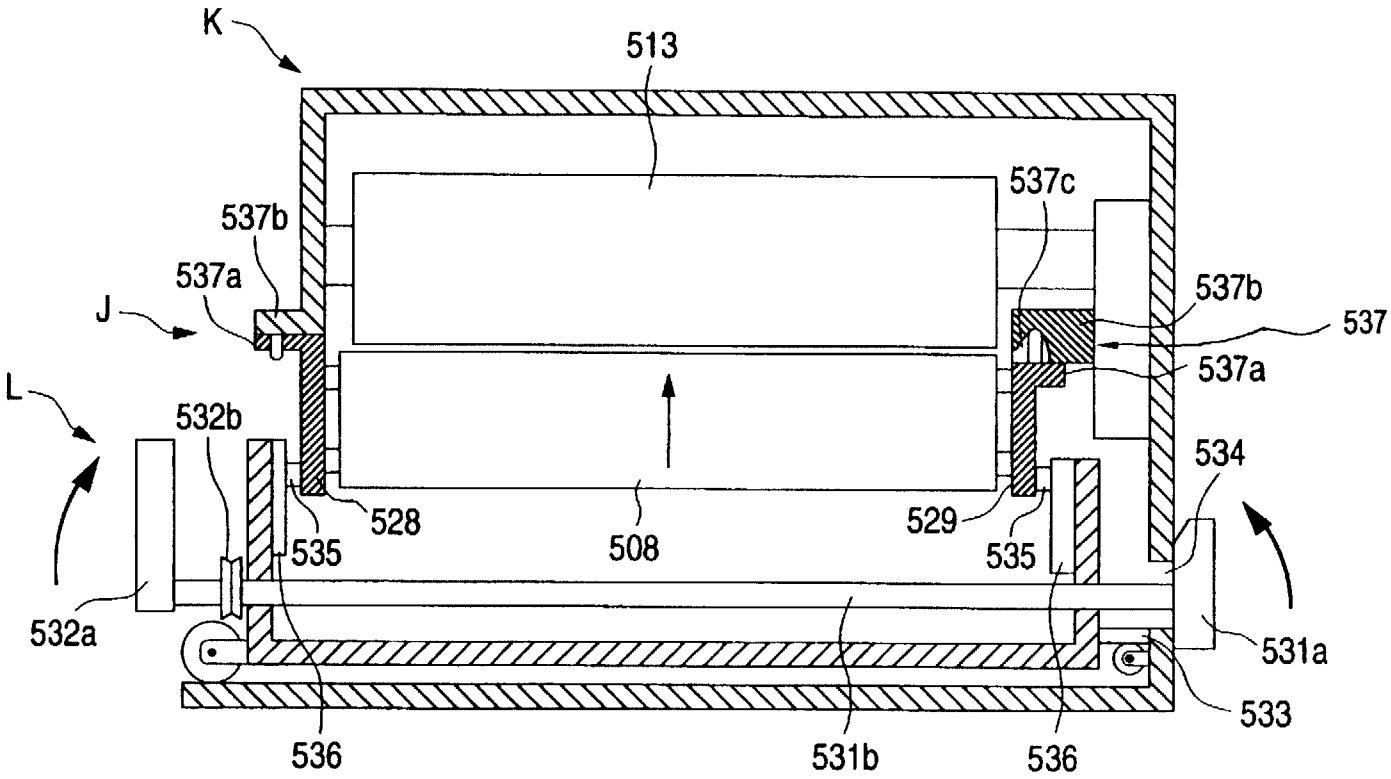
FIG. 39 is a main part sectional view of the color copier (when the roller frame moves up)
Figure 40:
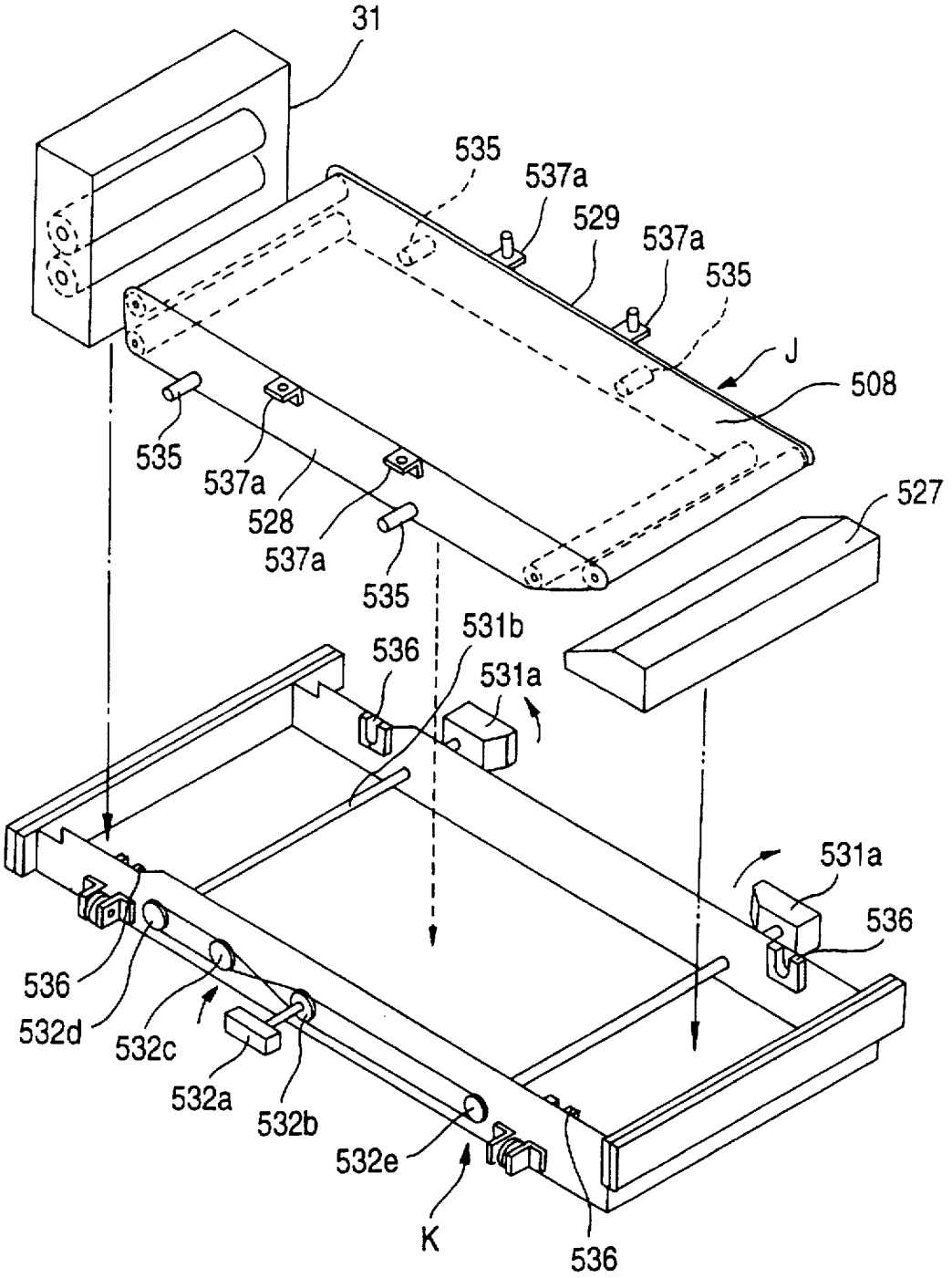
FIG. 40 is a perspective view of the roller frame and a drawer of the color copier.

An shown in FIGS. 38–40, the roller frame J has a front plate 528 and a rear plate 529 between which are the transfer belt 508, the four belt support rollers 518–521, four belt guides (not shown), four transfer corotrons (not shown), a stripper (not shown), and a belt electricity removal member (not shown). The belt support rollers 518–521 are disposed on the roller frame J via bearings.

The drawer L has a lidless box frame for housing the roller frame J, the fixing unit 31 (FIG. 2), and a belt cleaner unit 527 (FIG. 40).

The main frame K has a substantial box frame having an opening 530 made in the bottom of one side face, the opening 530 being sized to allow loading and unloading the drawer and the roller frame; members other than mentioned above are disposed.

In the embodiment, positioning unit for positioning the drawer L relative to the main frame K is provided. Specifically, a pair of drawer fixing units consisting of a drawer fixing cam 531*a* and a cam rotating shaft 531*b*, rotation drive unit 532 consisting of a handle 532*a* and pulleys 532*b*–532*e* disposed rotatably on the front for rotating the drawer fixing unit, and a pair of horizontal positioning pine 533 projected to the rear are formed in the drawer L, and a pair of cam fit holes 534 sized to allow the drawer fixing cam 531*a* to pass through are made in the main frame K. Thus, after the drawer L is inserted into the main frame K until the horizontal positioning pins 533 strike the rear of the main frame K, the handle 532*a* is turned, whereby the drawer fixing cam 531*a* can be engaged in the rear side face of the main frame K for fixing the drawer L to the main frame K.

In the embodiment, to support the roller frame J on the drawer L, roller frame support rods 535 are formed in four points of the lower margin side of the roller frame J and four support rod receptacles 536 for pinching and supporting the roller frame support rods 535 are formed in the drawer L.

Further, provided in the embodiment are a mechanism for moving the roller frame J in the drawer L up and down using rotation of the cam rotating shaft 531*b* and a positioning member 537 for positioning the roller frame J relative to the main frame K.

The positioning member 537 consists of roller frame positioning members 537*a* formed in two places of the upper margin of the front plate 528 of the roller frame J and in two places of the upper margin of the rear plate 529 and four main frame positioning members 537*b* formed in the main frame K surrounding the stations and fitted in the roller frame positioning members 537*a*. The roller frame positioning members 537*a* formed in the upper margin of the rear plate 529 are shaped like pins, and tapered holes 537*c* are made in the main frame positioning members 537*b* fitted in the roller frame positioning members 537*a*.

Figure 41:
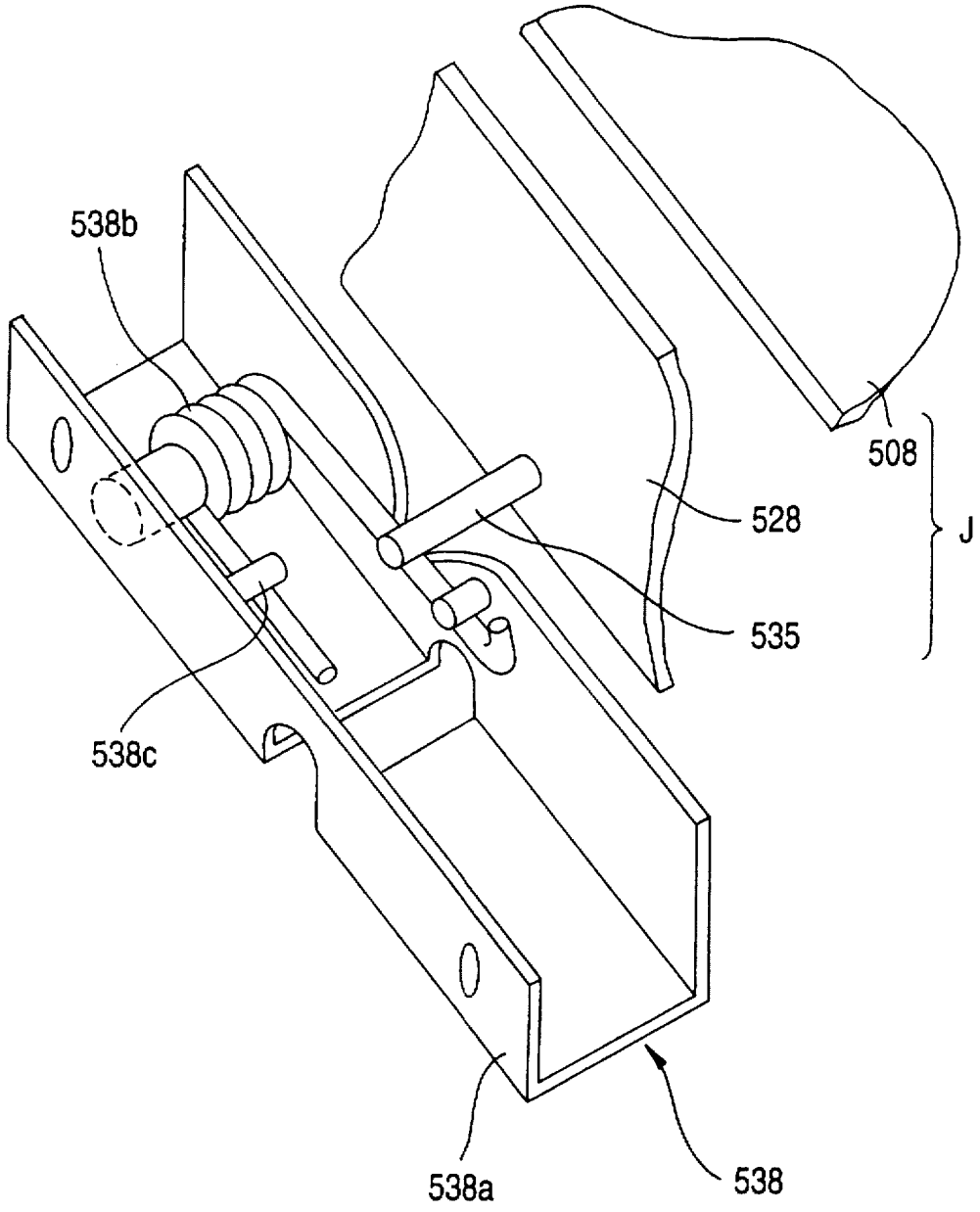
FIG. 41 is a perspective view of an elevator.
Figure 42:
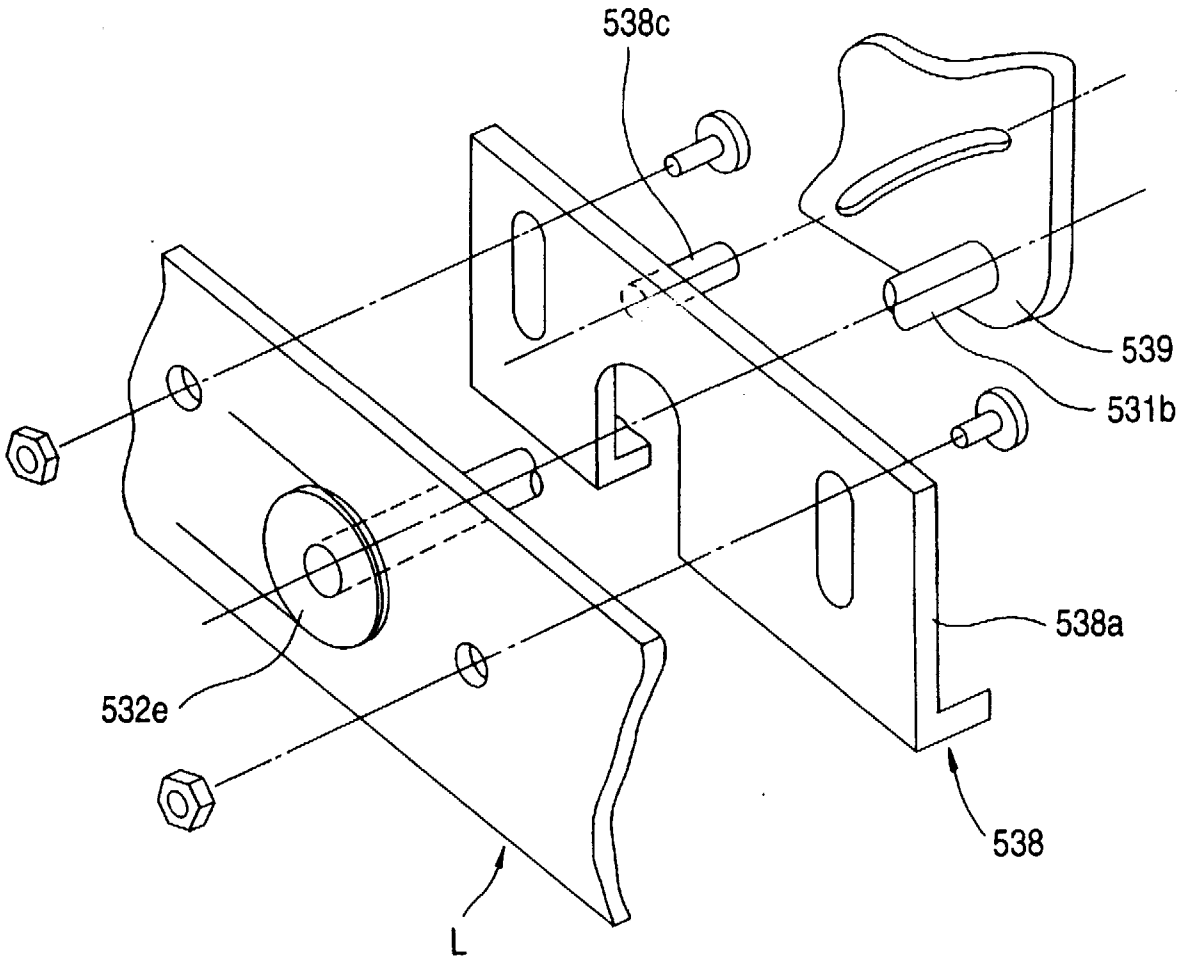
FIG. 42 is an illustration to show attachment of the elevator to the drawer.

As shown in FIGS. 41 and 42, the mechanism for moving the roller frame J in the drawer L up and down using rotation of the cam rotating shaft 531*b* consists of four elevators 538 being disposed in the drawer L slidably up and down for supporting the roller frame support rods 535 and four elevation cams 539 disposed in the cam rotation shaft 531*b*;

these are disposed in the drawer L. Each of the elevators 538 consists of an elevator main body 538*a* shaped substantially like U, an elastic member 538*b* being disposed therewithin for elastically supporting the roller frame support rod 535, and an elevator support rod 538*c* disposed in the elevator main body 538*a* and supported on the elevation cam 539.

The elevation cam 539 is shaped so as to lengthen the distance between the cam rotating shaft 531*b* and the elevator support rod 538*c* if the handle 532*a* is turned when the drawer L is inserted in the main frame L and fixed.

Figure 43A:
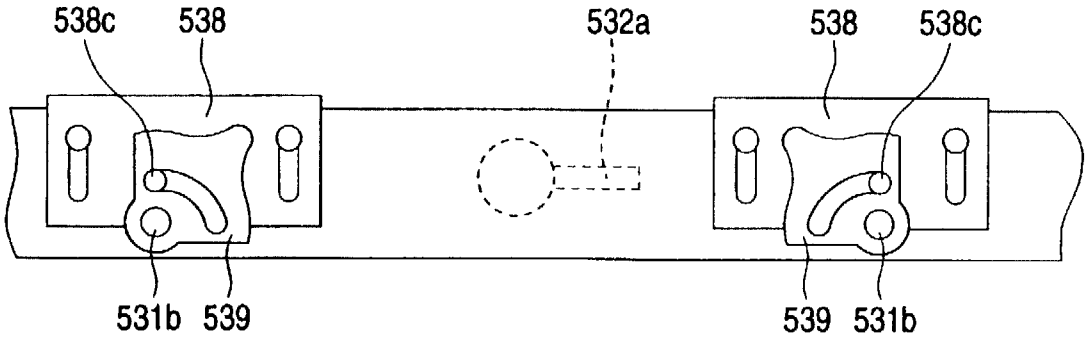
FIGS. 43A and 43B are illustrations to show down and up motion of the elevator, respectively.
Figure 43B:
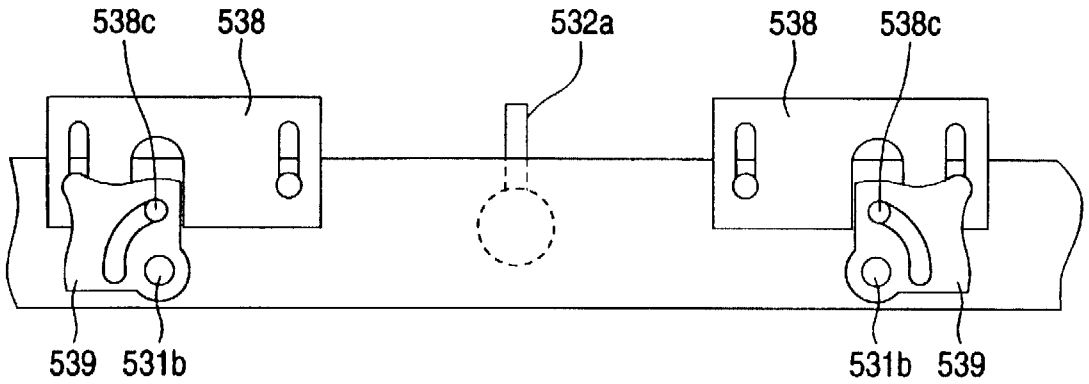

When the handle 532*a* is turned, as shown in FIGS. 43A and 43B, the elevation cam 539 rotates, lengthening the distance between the cam rotating shaft 531*b* and the elevator support rod 538*c*, accordingly causing the elevator 538 to rise.

Figure 44A:
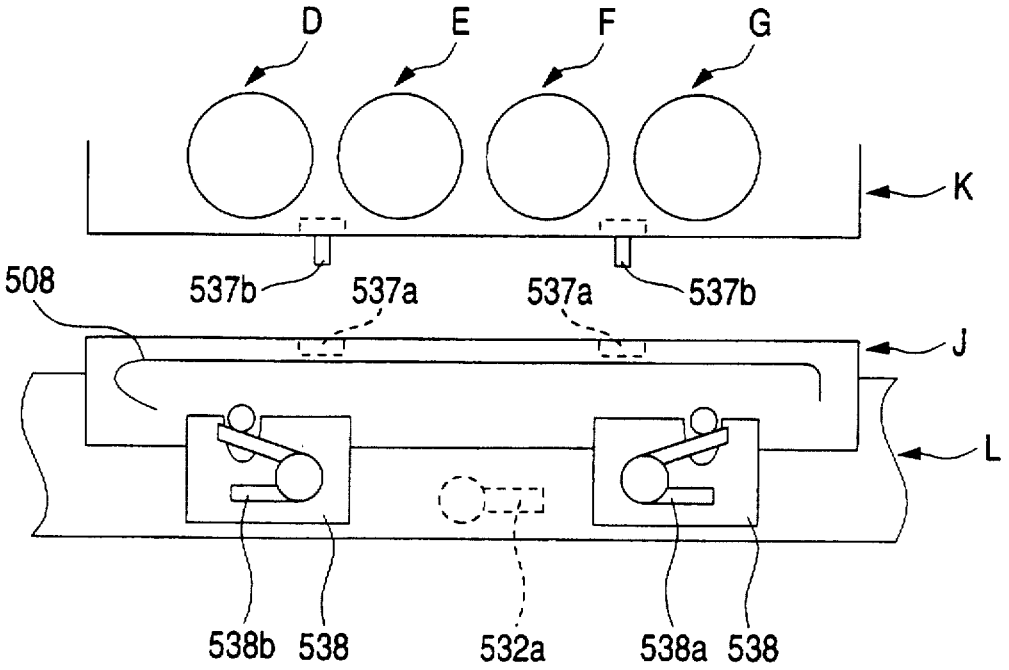
FIGS. 44A and 44B are illustrations to show down and up motion of the roller frame of the color copier, respectively.
Figure 44B:
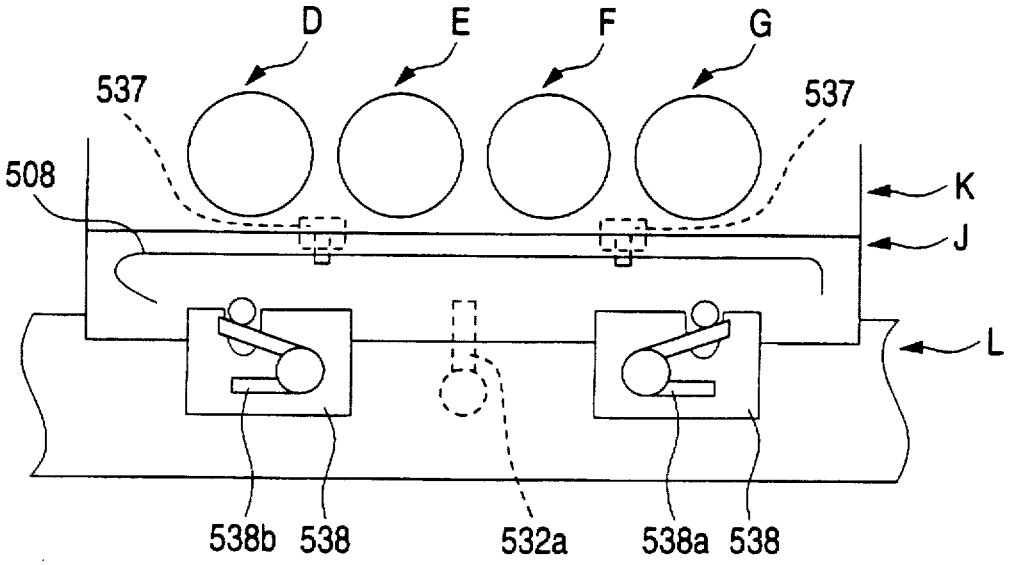

Therefore, in the color copier of the embodiment, as shown in FIGS. 44A and 44B, when the handle 532*a* is turned, the elevators 538 cause the roller frame J to be pushed up and abut the main frame K and the roller frame positioning members 537*a* to be fitted in the main frame positioning members 537*b* for positioning the transfer belt 508 relative to the four stations D–G.

In the color copier of the embodiment, the roller frame J is moved upward with the roller frame J placed on the elevators 538 moving up and down, the roller frame positioning pine are formed in the rear roller frame positioning members 537*a* and the substantially tapered holes 537*c* are made in the rear main frame positioning members 537*b*, so that the roller frame J is guided into the tapered holes 537*c* in a horizontally movable condition and is properly positioned relative to the main frame K.

Further, in the color copier of the embodiment, the roller frame J is pushed up via the elastic members 538*b*, thus the roller frame J and the main frame K are not distorted so long as they are properly positioned without causing an unnecessary force to act on the roller frame J or the main frame K with the roller frame J abutting the main frame K.

Therefore, in the color copier of the embodiment, in a state in which the cam rotating shaft 531*b* completely rotates, it can be assumed that the roller frame J can be properly positioned relative to the main frame K without distorting the roller frame J or the main frame K.

In the embodiment, there are provided four detection unit 540, 541, 542, and 543 for detecting a change in the positional interrelationships among the four belt support rollers 518–521, and belt drive control unit 544 for disabling a drive motor from turning if each of the detection unit detects a positional relationship change.

Figure 45:
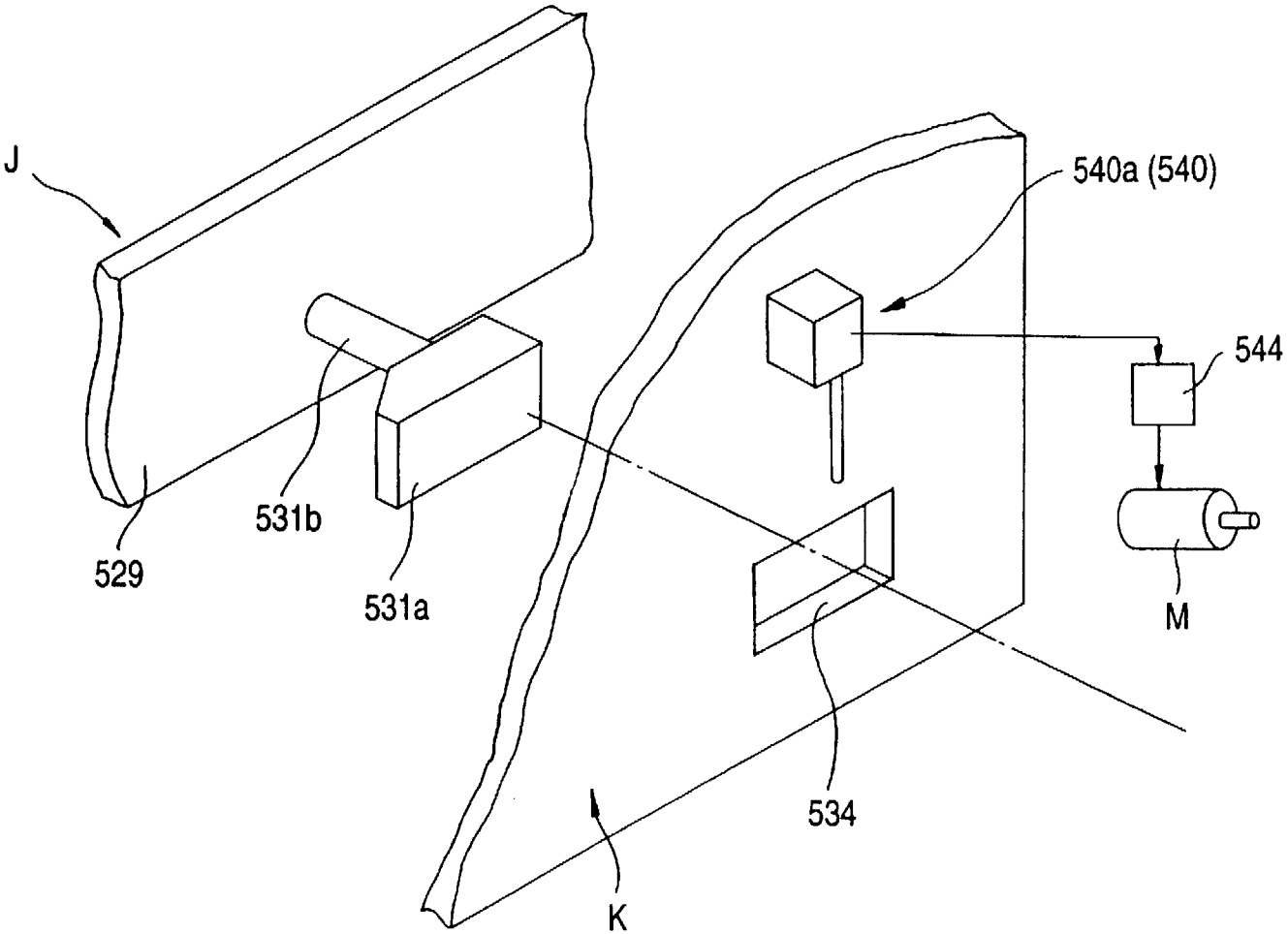
FIG. 45 is an illustration to show the configuration of first detection unit and belt drive control unit.
Figure 46A:
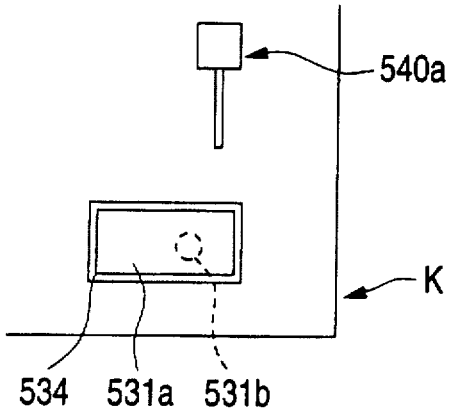
FIGS. 46A and 46B is an illustration to show motion of OFF state and ON state of the first detection unit, respectively.
Figure 46B:
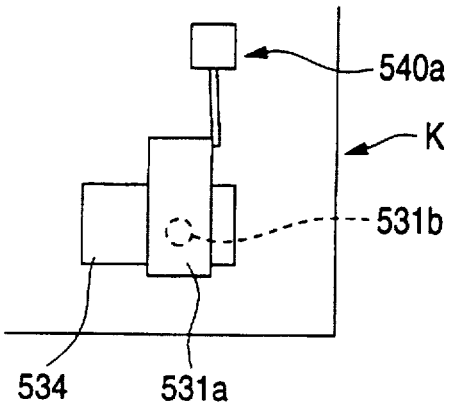

As shown in FIG. 45, the first detection unit 540 is made of a limit switch 540*a* being disposed in the proximity of the cam fit hole 534 for sensing rotation of the drawer fixing cam 531*a*. As shown in FIGS. 46A and 46B, the limit switch 540*a* is disposed so as to turn on if the drawer fixing cam 531*a*, namely, the cam rotating shaft 531*b* rotates completely. Therefore, for example, if the roller frame positioning members 537*a* cannot properly be fitted in the main frame positioning members 537*b* and the drawer fixing cam 531*a* (cam rotating shaft 531*b*) cannot completely rotate, the limit switch 540*a* does not turn on.

The belt drive control unit 544 controls the drive motor M so that the drive motor M cannot be turned until the limit switch 540*a* turns on.

Thus, in the color copier of the embodiment, for example, if the roller frame positioning members 537*a* cannot properly be fitted in the main frame positioning members 537*b* and the roller frame J, etc., is distorted, the first detection unit 540 and the belt drive control unit 544 can detect a change in the positional interrelationships among the four belt support rollers 518–521 caused by the distortion of the roller frame J, etc., and inhibit driving the transfer belt 508, so that the transfer belt 508 does not abut the roller frame J, etc., and become damaged. The first detection unit 540 can mainly detect a change in a twist direction.

Figure 47:
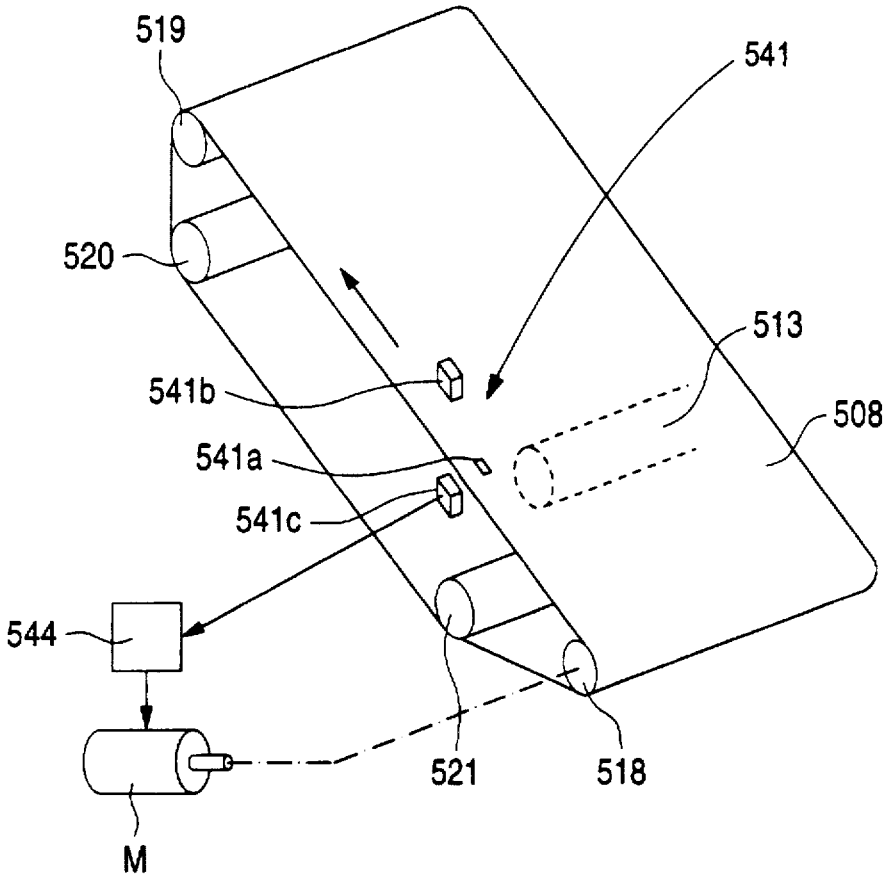
FIG. 47 is an illustration to show the configuration of first detection unit and belt drive control unit.

As shown in FIG. 47, the second detection unit 541 consists of a through hole 541*a* made in one end of the transfer belt 508 and a light emitting element 541*b* and a light receiving element 541*c* for optically detecting a position of the through hole 541*a*. The light emitting element 541*b* and the light receiving element 541*c* are disposed so as to detect the position of the through hole 541*a* when the transfer belt 508 is turned normally; when the through hole 541*a* is positioned therebetween, the second detection unit outputs a detection signal. Therefore, if the transfer belt 508 moves by a predetermined distance in the rotating shaft direction of the belt support rollers 518–521, the through hole 541*a* does not come between the light emitting element 541*b* and the light receiving element 541*b* and no detection signal is output.

If another detection signal is not input although the time corresponding to one period of the transfer belt 506 has elapsed since one detection signal was input with the transfer belt 508 driven, the belt drive control unit 544 stops the drive motor M. When driving the belt has been stopped three times, the belt drive control unit 544 inhibits driving the transfer belt 508.

Thus, in the color copier of the embodiment, if the positional interrelationships among the four belt support rollers 518–521 delicately changes, the second detection unit 541 and the belt drive control unit 544 can detect the forwarding distance of the transfer belt 508 in the rotating shaft direction of the belt support rollers 518–521 associated with the delicate change and inhibit driving the transfer belt 508, so that the transfer belt 508 does not abut the roller frame J, etc., and become damaged. The second detection unit 541 can equally detect both a parallelism change and a change in a twist direction.

Figure 48:
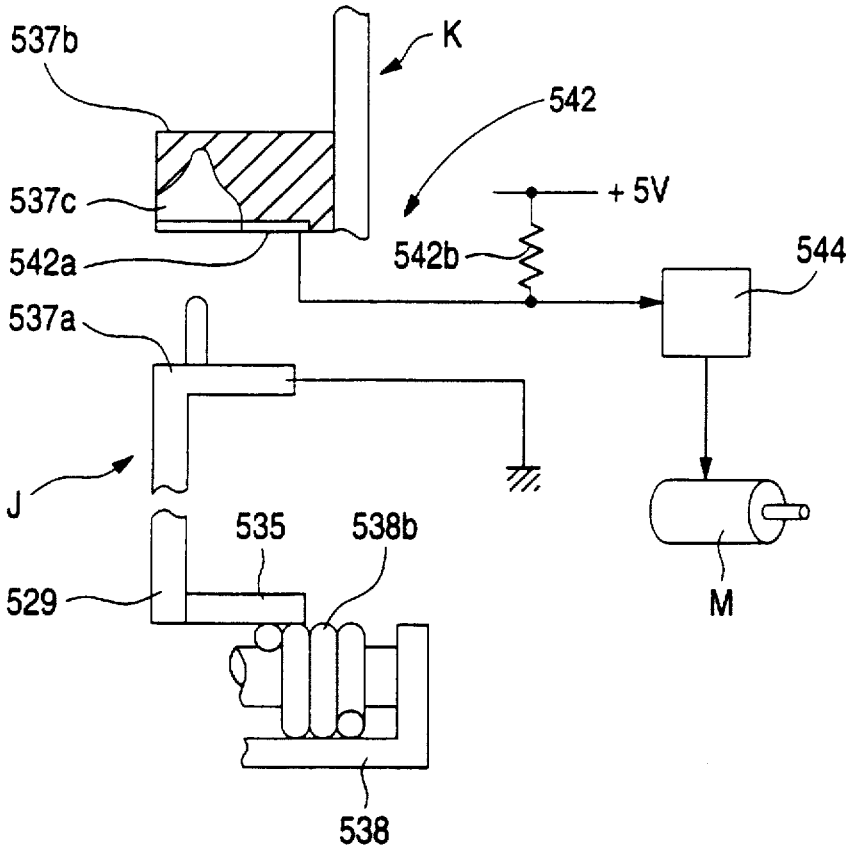
FIG. 48 is an illustration to show the configuration of first detection unit and belt drive control unit.

As shown in FIG. 48, the third detection unit 542 has four conductive pads 542*a* disposed on the bottom face of each main frame positioning member 537*b* made of an insulating material and connected to +5 V via a resistor 542*b*, the roller frame J being connected to a ground potential. The potential of each conductive pad 542*a* becomes 0 V when the roller frame positioning member 537*a* abuts; it becomes +5 V when the roller frame positioning member 537*a* does not abut. Therefore, for example, when the roller frame J is lifted up, if the roller frame positioning members 537*a* cannot be made to abut against the main frame positioning members 537*b* because of time-varying degradation of the elastic members 538*b* for elastically supporting the roller frame J, the conductive pads become +5 V.

The belt drive control unit 544 controls the drive motor M so that the drive motor M cannot be turned until the potential of every conductive pad 542*a* becomes 0 V.

Thus, in the color copier of the embodiment, for example, when the elastic members 538*b* for elastically supporting the roller frame J degrade with time and the roller frame J is lifted up, if the roller frame J, etc., is distorted, the third detection unit 542 and the belt drive control unit 544 can detect a change in the positional interrelationships among the four belt support rollers 518–521 caused by the distortion of the roller frame J, etc., and inhibit driving the transfer belt 508, so that the transfer belt 508 does not abut the roller frame J, etc., and become damaged. The third detection unit 542 can mainly detect a change in a twist direction.

Figure 49:
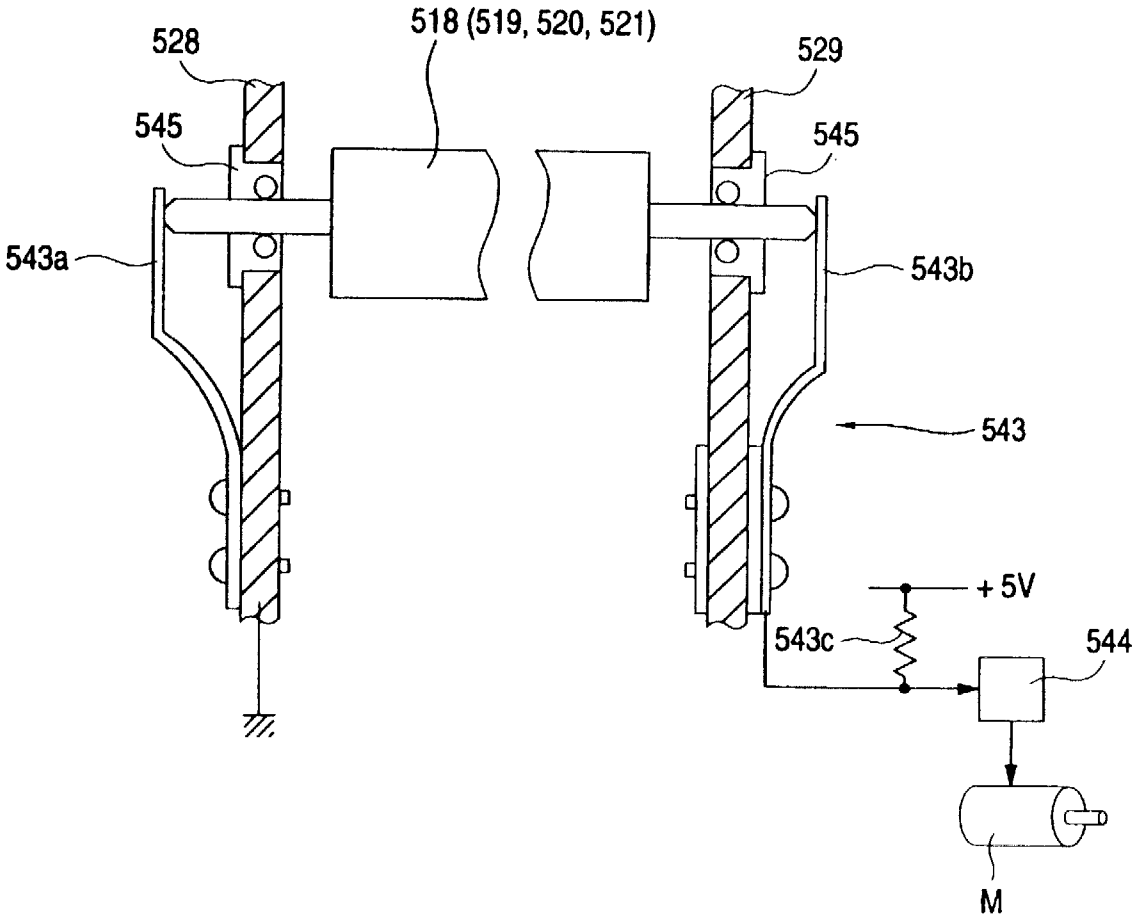
FIG. 49 is an illustration to show the configuration of first detection unit and belt drive control unit.
Figure 50:
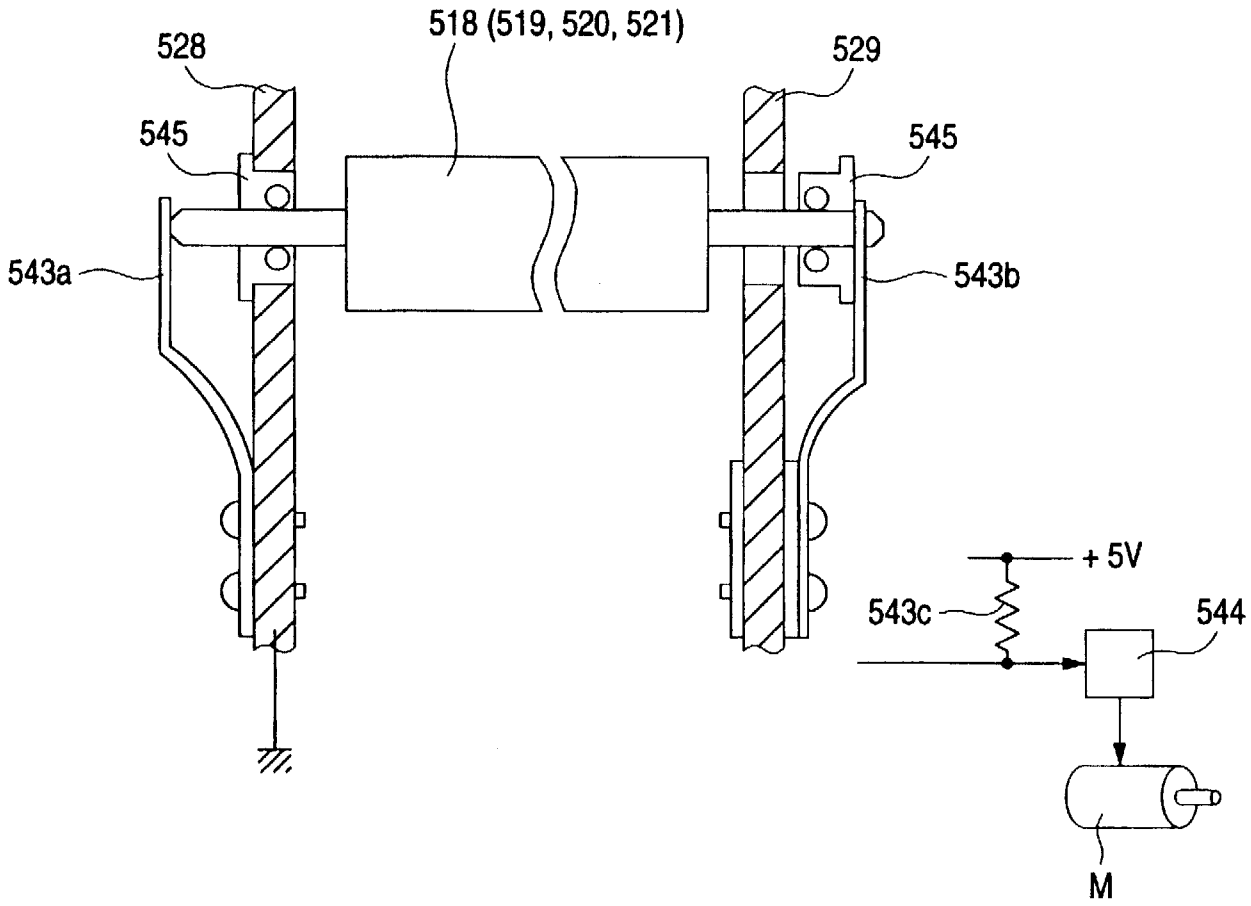
FIG. 50 is an illustration to show a state in which a belt support roller falls.

As shown in FIG. 49, the fourth detection unit 543 comprises first conductive members 543*a* each made to abut against one end of the corresponding belt support roller 518–521 and connected to a ground potential and second conductive members 543*b* each made to abut against the other end of the corresponding belt support roller 518–521 and connected to +5 V via a resistor 543*c*. The potential of each second conductive member 543*b* becomes 0 V when the second and first conductive members 543*b* and 543*a* are in a conduction condition via the corresponding belt support roller 518–521; it becomes +5 V when they are not in a conduction condition. Therefore, for example, as shown in FIG. 50, if one of the belt support rollers 518–521 together with a bearing 545 falls out of the frame 528, 529 and the corresponding second and first conductive members 543*b* and 543*a* are placed out of conduction, the second conductive member 543*b* becomes +5 V.

The belt drive control unit 544 controls the drive motor M so that the drive motor M cannot be turned until the potential of every second conductive member 543*b* becomes 0 V.

Thus, in the color copier of the embodiment, for example, if one of the belt support rollers 518–521 together with the bearing 545 falls out of the frame 528, 529, the fourth detection unit 543 and the belt drive control unit 544 can detect a change in the positional interrelationships among the four belt support rollers 518–521 caused by the falling of the belt support roller, and inhibit driving the transfer belt 508, so that the transfer belt 508 does not abut the roller frame J, etc., and become damaged. The fourth detection unit 543 can mainly detect a parallelism change.

As we have discussed, according to the invention, there can be provided an image forming apparatus capable of reliably preventing damage such as buckling or a fracture from occurring at an end of a transfer belt in a simple structure at low costs if the transfer belt abnormally moves in a direction perpendicular to the forwarding direction of the transfer belt, an image forming apparatus capable of reducing a walk force given by rollers having spiral elastic fins to a transfer belt, thereby reducing an edge force acting on an end of the transfer belt, and an image forming apparatus capable of preventing damage to a transfer belt if positional interrelationships among rollers change.

What is claimed is:

1. An image forming apparatus comprising:

an endless transfer belt; and a plurality of rollers for supporting and transporting said transfer belt;

at least one of said plurality of rollers including:

a guide member being disposed at one or both ends for guiding said transfer belt while allowing a predetermined amount of motion in an edge direction of said transfer belt; and means for sensing an abnormal move of said transfer belt in a direction perpendicular to a forwarding direction thereof to prevent damage to edges of said transfer belt, wherein when said means for sensing an abnormal move of said transfer belt in the direction perpendicular to the forwarding direction of said transfer belt senses an abnormal move of said transfer belt in the direction perpendicular to the forwarding direction of said transfer belt a predetermined number of times, regardless of whether power of the system has been turned off and then on, said transfer belt is stopped.

2. An image forming apparatus as claimed in claim 1, wherein said means for sensing an abnormal move of said transfer belt in the direction perpendicular to the forwarding direction of said transfer belt comprises means for sensing motion of said guide member.

3. An image forming apparatus as claimed in claim 1, wherein said means for sensing an abnormal move of said transfer belt in the direction perpendicular to the forwarding direction of said transfer belt comprises;

a substantially rectangular belt hole formed in an end of said transfer belt;

a belt hole detection sensor for sensing said belt hole; and belt clock count means synchronized with move speed of said transfer belt;

wherein a forwarding condition of said transfer belt is monitored in response to a belt clock count result of said belt clock count means.

4. An image forming apparatus as claimed in claim 3, wherein a breakage condition of said belt hole is monitored in response to the belt clock count of said belt hole.

5. An image forming apparatus as claimed in claim 1, further comprising means for sensing rotation of at least one driven roller of said plurality of rollers, said means for sensing rotation being provided at an end of said driven roller.

6. An image forming apparatus comprising:

an endless transfer belt;

a plurality of rollers for supporting and transporting said transfer belt; and detecting means for detecting a predetermined position in a forwarding direction of said transfer belt, said detecting means serving as at least means for detecting a seam position of said transfer belt, and means for sensing an abnormal move of said transfer belt in a direction perpendicular to a forwarding direction thereof to prevent damage to edges of said transfer belt.

7. An image forming apparatus as claimed in claim 6, wherein when said means for sensing an abnormal move of said transfer belt in the direction perpendicular to the forwarding direction of said transfer belt senses an abnormal move of said transfer belt in the direction perpendicular to the forwarding direction of said transfer belt a predetermined number of times, regardless of whether power of the system has been turned off and then on, said transfer belt is stopped.

8. An image forming apparatus as claimed in at least one claim 6, wherein said means for sensing an abnormal move of said transfer belt in the direction perpendicular to the forwarding direction of said transfer belt comprises means for sensing motion of at least one guide member.

9. An image forming apparatus as claimed in claim 6, wherein said means for sensing an abnormal move of said transfer belt in the direction perpendicular to the forwarding direction of said transfer belt comprises:

a substantially rectangular belt hole formed in an end of said transfer belt;

a belt hole detection sensor for sensing said belt hole; and belt clock count means synchronized with move speed of said transfer belt;

wherein a forwarding condition of said transfer belt is monitored in response to a belt clock count result of said belt clock count means.

10. An image forming apparatus as claimed in claim 9, wherein a breakage condition of said belt hole is monitored in response to the belt clock count of said belt hole.

11. An image forming apparatus comprising:

an endless transfer belt;

a plurality of rollers for supporting and transporting said transfer belt;

adjusting means for adjusting a position in a direction perpendicular to a forwarding direction of said transfer belt by displacing one of said rollers when said transfer belt is replaced or an installation place of a main unit of said system is moved;

a member for visually checking an end position of said transfer belt when the transfer belt stops, adjusted by said adjustment means; and means for sensing an abnormal move of said operating transfer belt in the direction perpendicular to the forwarding direction of said transfer belt, wherein when said means for sensing an abnormal move of said transfer belt in the direction perpendicular to the forwarding direction of said transfer belt senses an abnormal move of said transfer belt in the direction perpendicular to the forwarding direction of said transfer belt a predetermined number of times, regardless of whether power of the system has been turned off and then on, said transfer belt is stopped.

12. An image forming apparatus as claimed in claim 11, wherein said means for sensing an abnormal move of said transfer belt in the direction perpendicular to the forwarding direction of said transfer belt comprises means for sensing motion of at least one guide member.

13. An image forming apparatus as claimed in claims 11, wherein said means for sensing an abnormal move of said transfer belt in the direction perpendicular to the forwarding direction of said transfer belt comprises:

a substantially rectangular belt hole formed in an end of said transfer belt;

a belt hole detection sensor for sensing said belt hole; and belt clock count means synchronized with move speed of said transfer belt;

wherein a forwarding condition of said transfer belt is monitored in response to a belt clock count result of said belt clock count means.

14. An image forming apparatus as claimed in claim 13, wherein a breakage condition of said belt hole is monitored in response to the belt clock count of said belt hole.

15. An image forming apparatus as claimed in claim 11, wherein when said adjusting means adjusts a position in a direction perpendicular to the forwarding direction of said transfer belt, said transfer belt always stops at a constant position after said transfer belt turns a predetermined integral times.

16. An image forming apparatus comprising:

an endless transfer belt;

a plurality of rollers for supporting and transporting said transfer belt;

a guide member being disposed at one or both ends of at least one of said rollers for guiding said transfer belt while allowing a predetermined amount of motion in an edge direction of said transfer belt;

a substantially rectangular belt hole formed in an end of said transfer belt in a direction perpendicular to a forwarding direction of said transfer belt; and a side plate member for supporting said rollers;

wherein when it is assumed that the maximum move distance of said guide member is L1, a half of a length of said belt hole is L2, and a clearance between an and of said transfer belt and said side plate member is L3, said image forming apparatus satisfies L1>L2 and L3>L2.

* * * * *